US007316396B2

(12) United States Patent
Ohira

(10) Patent No.: US 7,316,396 B2
(45) Date of Patent: Jan. 8, 2008

(54) CARD GAME MACHINE

(75) Inventor: Teruo Ohira, Gifu-ken (JP)

(73) Assignees: Ohiragiken Industry Co., Gifu-ken (JP); Atlas Co., Tokyo (JP)

( * ) Notice: Subject to any disclaimer, the term of this patent is extended or adjusted under 35 U.S.C. 154(b) by 0 days.

(21) Appl. No.: 10/892,905

(22) Filed: Jul. 16, 2004

(65) Prior Publication Data

US 2005/0206076 A1 Sep. 22, 2005

(30) Foreign Application Priority Data

Jul. 18, 2003 (JP) ..... 2003-276438

(51) Int. Cl.
*A63F 1/12* (2006.01)

(52) U.S. Cl. ..... 273/149 R; 463/11

(58) Field of Classification Search ..... 273/149 R, 273/149 P, 149; 463/11
See application file for complete search history.

(56) References Cited

U.S. PATENT DOCUMENTS 2,051,615 A * 8/1936 Miles ..... 273/149 P
2,666,645 A * 1/1954 Phillips ..... 273/296
3,114,553 A * 12/1963 Stone, Sr. ..... 273/149 P
3,222,071 A * 12/1965 Lang ..... 273/293
3,377,070 A * 4/1968 Nottoli ..... 273/294
3,529,829 A * 9/1970 Seifert ..... 273/149 P
4,822,050 A * 4/1989 Normand et al. ..... 273/149 P
5,121,921 A * 6/1992 Friedman et al. ..... 273/149 P
5,240,140 A * 8/1993 Huen ..... 221/13
5,431,399 A * 7/1995 Kelley ..... 273/149 P
6,543,770 B1 * 4/2003 Kaji et al. ..... 273/148 R
6,588,751 B1 * 7/2003 Grauzer et al. ..... 273/149 R
6,651,981 B2 * 11/2003 Grauzer et al. ..... 273/149 R
6,651,982 B2 * 11/2003 Grauzer et al. ..... 273/149 R
6,655,684 B2 * 12/2003 Grauzer et al. ..... 273/149 R

OTHER PUBLICATIONS

Abstract of Japanese Patent Publication No. 04-371186, Pub. Date: Dec. 24, 1992, Patent Abstracts of Japan.
Abstract of Japanese Patent Publication No. 2001-087448, Pub. Date: Apr. 3, 2001, Patent Abstracts of Japan.

(Continued)

*Primary Examiner*—Eugene Kim
*Assistant Examiner*—D Collins
(74) *Attorney, Agent, or Firm*—Martine Penilla & Gencarella, LLP

(57) ABSTRACT

A card game machine using plural cards on front surface sides of which distinctive information for identifying itself from others is displayed and designs of back sides of which have a commonality is provide. The card game comprises a holding unit for holding the plural cards with a same shape in a stacked state, a distribution unit for distributing the plural cards held by the holding unit one by one in a state where the card is placed face down, a tilt surface for sliding the card distributed by the distribution unit, a stop unit for stopping the card sliding on the tilt surface at a specified position of the tilt surface and a card reversing unit for forcibly reversing the card stopped by the stop unit so that the front surface side is exposed and display contents depicted on the surface of the card can be visually seen, wherein a specified profit is given to a player on the basis of the distinctive information of the reversed card.

18 Claims, 25 Drawing Sheets

OTHER PUBLICATIONS

Abstract of Japanese Patent Publication No. 2001-327647, Pub. Date: Nov. 27, 2001, Patent Abstracts of Japan.
Abstract of Japanese Patent Publication No. 2002-102529, Pub. Date: Apr. 9, 2002, Patent Abstracts of Japan.
Abstract of Japanese Patent Publication No. 2002-143367, Pub. Date: May 21, 2002, Patent Abstracts of Japan.
Abstract of Japanese Patent Publication No. 2002-165916, Pub. Date: Jun. 11, 2002, Patent Abstracts of Japan.

* cited by examiner

CARD GAME MACHINE

FIELD OF THE INVENTION

The present invention relates to a card game machine using actual cards.

BACKGROUND ART

Conventionally, as a game machine using, for example, cards, there is one in which not actual cards, but images of false cards are displayed on a display screen. A player sees the card images displayed on the display screen and plays a game.

However, the card game machine as stated above has problems as follows.

1) In the card game machine as stated above, the play is not performed using actual cards, and the card images different from the actual cards are merely displayed on the display screen, and therefore, there has been a problem that reality is lacking.

2) In the card game machine as stated above, since distribution of cards is performed by a computer on the basis of a program, as the play is repeated, the player can grasp the pattern of the game executed by the computer to some degree, and can predict victory or defeat of the game to some degree. Thus, there has been a problem that the interest of the game is lost.

Although the above problems are resolved by using real cards, in the case where the real cards are used, a very difficult operation, such as reversal of the card, is required. Thus, it is difficult to use the real cards in the game machine.

An object of the invention is to provide a card game machine in which, without using false cards such as images, real cards are used at low cost, and reality and interest can be improved.

SUMMARY OF THE INVENTION

For achieving the objectives of the present invention, a card game machine using plural cards on front surface sides of which distinctive information for identifying itself from others is displayed and designs of back sides of which have a commonality is provide. The card game comprises a holding unit for holding the plural cards with a same shape in a stacked state, a distribution unit for distributing the plural cards held by the holding unit one by one in a state where the card is placed face down, a tilt surface for sliding the card distributed by the distribution unit, a stop unit for stopping the card sliding on the tilt surface at a specified position of the tilt surface and a card reversing unit for forcibly reversing the card stopped by the stop unit so that the front surface side is exposed and display contents depicted on the surface of the card can be visually seen, wherein a specified profit is given to a player on the basis of the distinctive information of the reversed card.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objectives and advantages thereof, may best be understood by reference to the following description of the present preferred embodiments together with the accompanying drawings in which:

BEST MODE FOR CARRYING OUT THE INVENTION

Hereinafter, an embodiment embodying the invention will be described with reference to the drawings.

Figure 1:
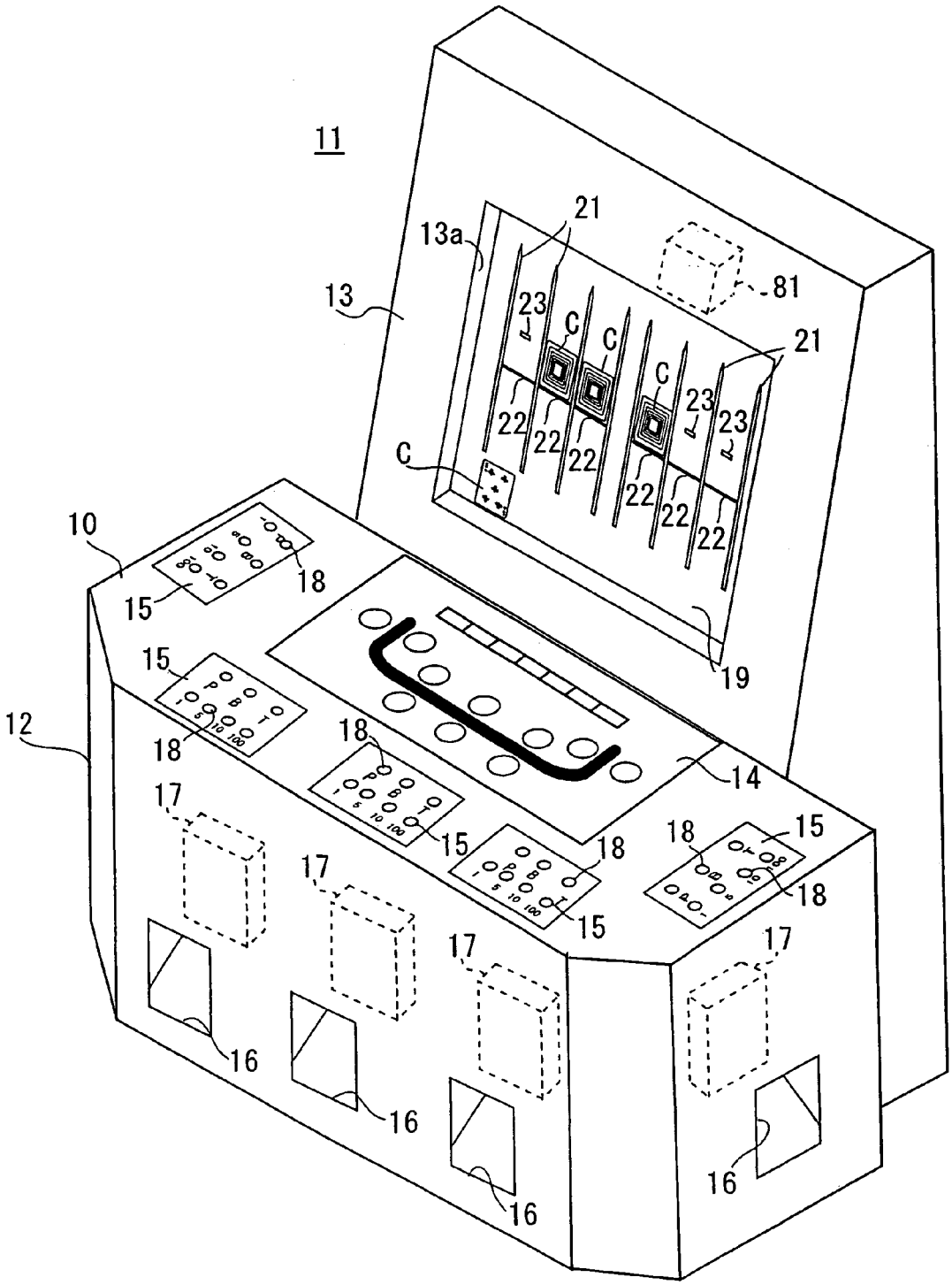
FIG. 1 is a perspective view of a card game machine according to an embodiment of the invention.

As shown in FIG. 1, a card game machine 11 is halved into an operation part 12 and an exhibition part 13. A monitor 14 for displaying various images is disposed on a surface of an operation table 10 as an upper surface of the operation part 12. Five control panels 15 are disposed around the monitor 14 at five places so as to surround the monitor 14. Medal delivery ports 16 corresponding to the control panels 15 are respectively provided at sides of the operation part 12. Medal delivery devices 17 corresponding to the medal delivery ports 16 are respectively disposed in the inside of the operation part 12. A player operates buttons 18 of the control panel 15 to input a mark and a numeral to desired positions of the monitor 14.

A largely cut window 13*a* is formed on a front surface of the exhibition part 13, and a transparent acryl plate 20 is fitted to the position of the window 13*a*. A table 19 for cards is disposed in the inside of the exhibition part 13. The table is exposed at the window 13*a* through the acryl plate 20 toward the outside. The table is disposed in front of a base 54 described later.

Figure 2:
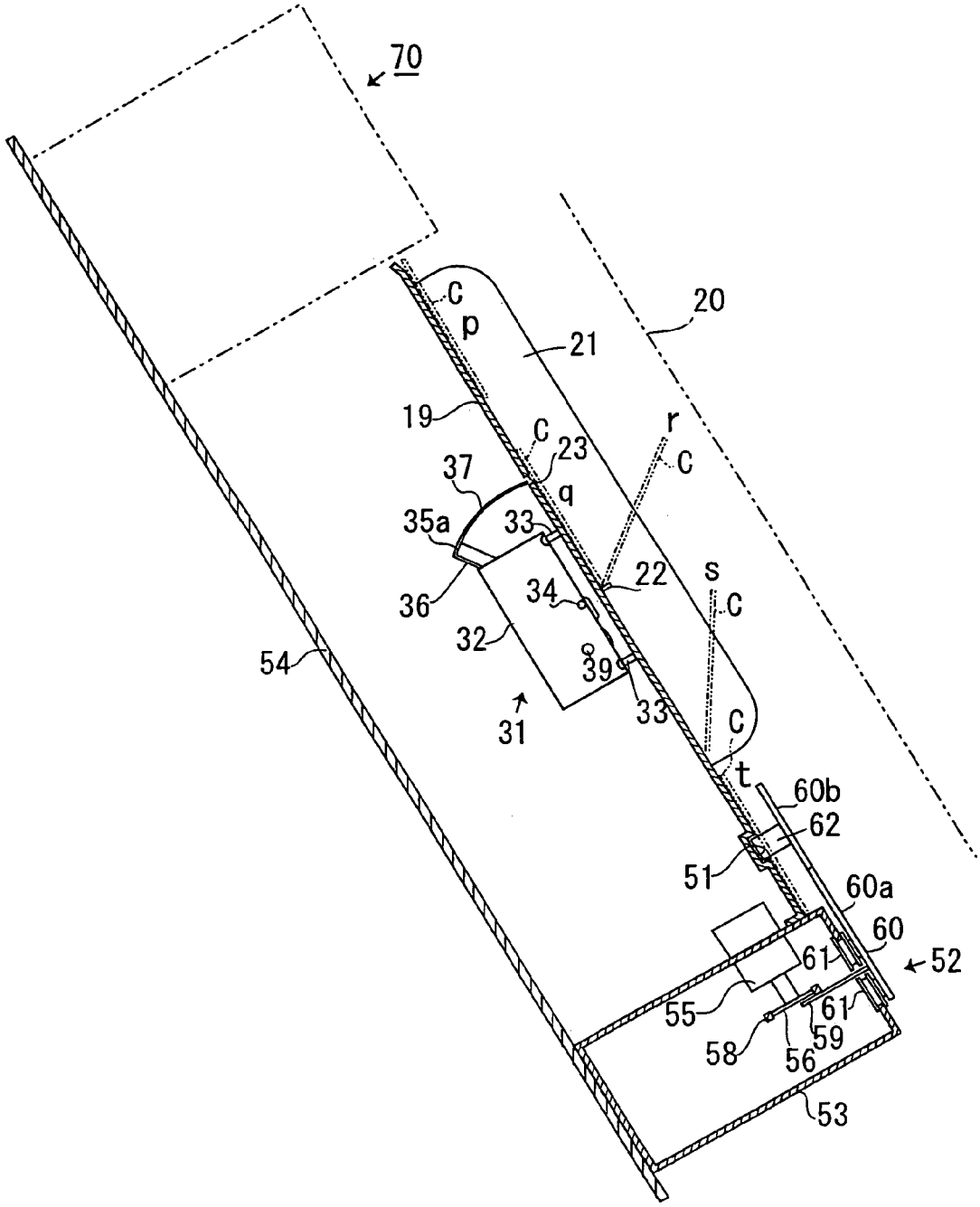
FIG. 2 is a side sectional view of a card table of the embodiment.

As shown in FIGS. 1 and 2, the table 19 is constructed into a plane shape, and the surface of the table 19 is a tilt surface whose lower side projects more forward than its upper side. In this embodiment, the table 19 is constructed of a stainless plate member. A hairline processing for facilitating a slide of a card C is applied to the surface of the table 19.

Figure 3:
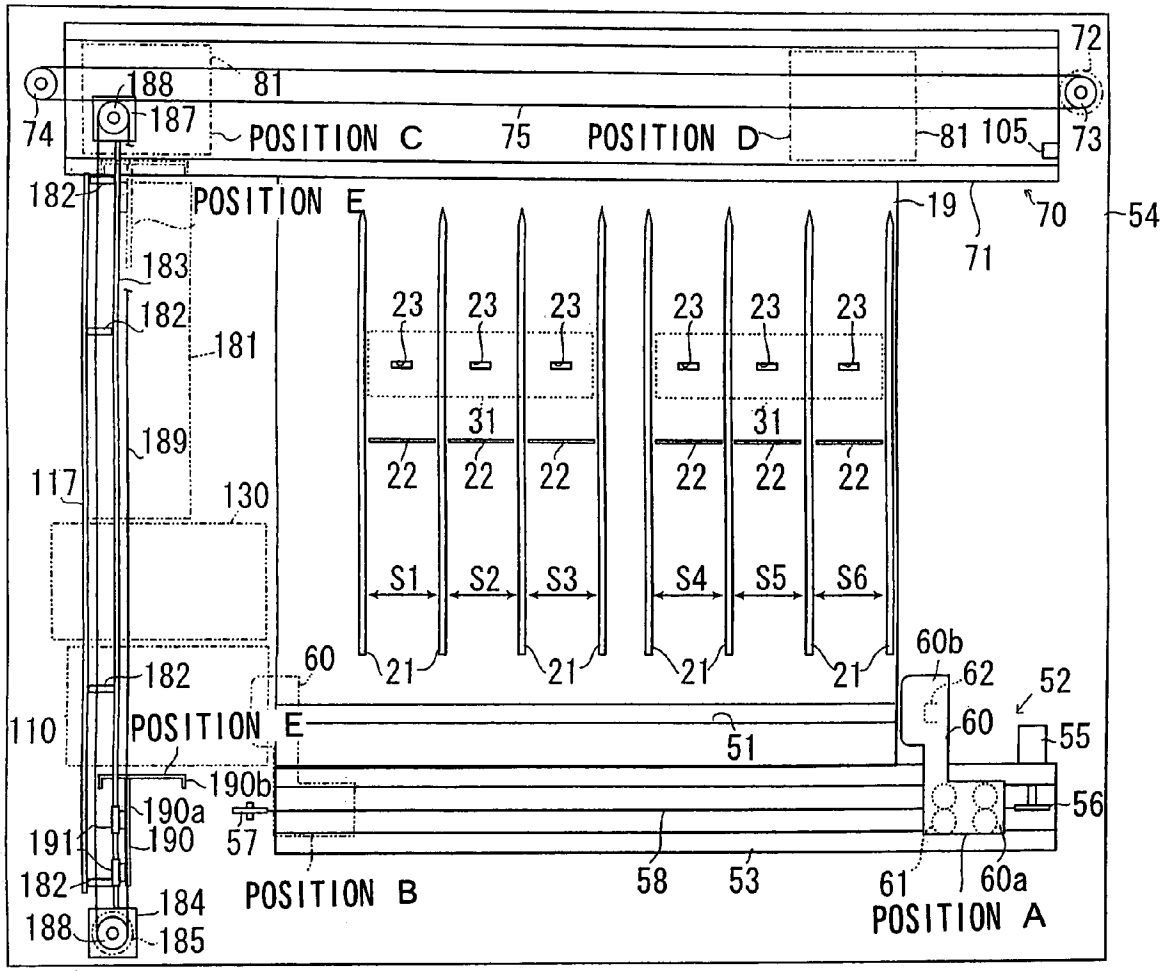
FIG. 3 is a plan view of the card table of the embodiment.

As shown in FIGS. 1 to 3, a total of 8 guide plates 21 extending in the vertical direction are disposed on the surface of the table 19. The guide plates 21 are divided into right and left two groups each including four plates. Constant intervals are provided between the adjacent guide plates 21 in each of the groups. These are made a first to a sixth spaces S1 to S6. The width of each of the spaces S1 to S6 is slightly larger than the width of the card C. Stoppers 22 extending in the horizontal direction are disposed at the centers of the respective spaces S1 to S6. Each of the stoppers 22 is provided in a state where it projects from the surface of the table 19 by 2 to 3 mm. Through holes 23 are formed at upper areas of the respective stoppers 22 of the table 19.

Figure 4:
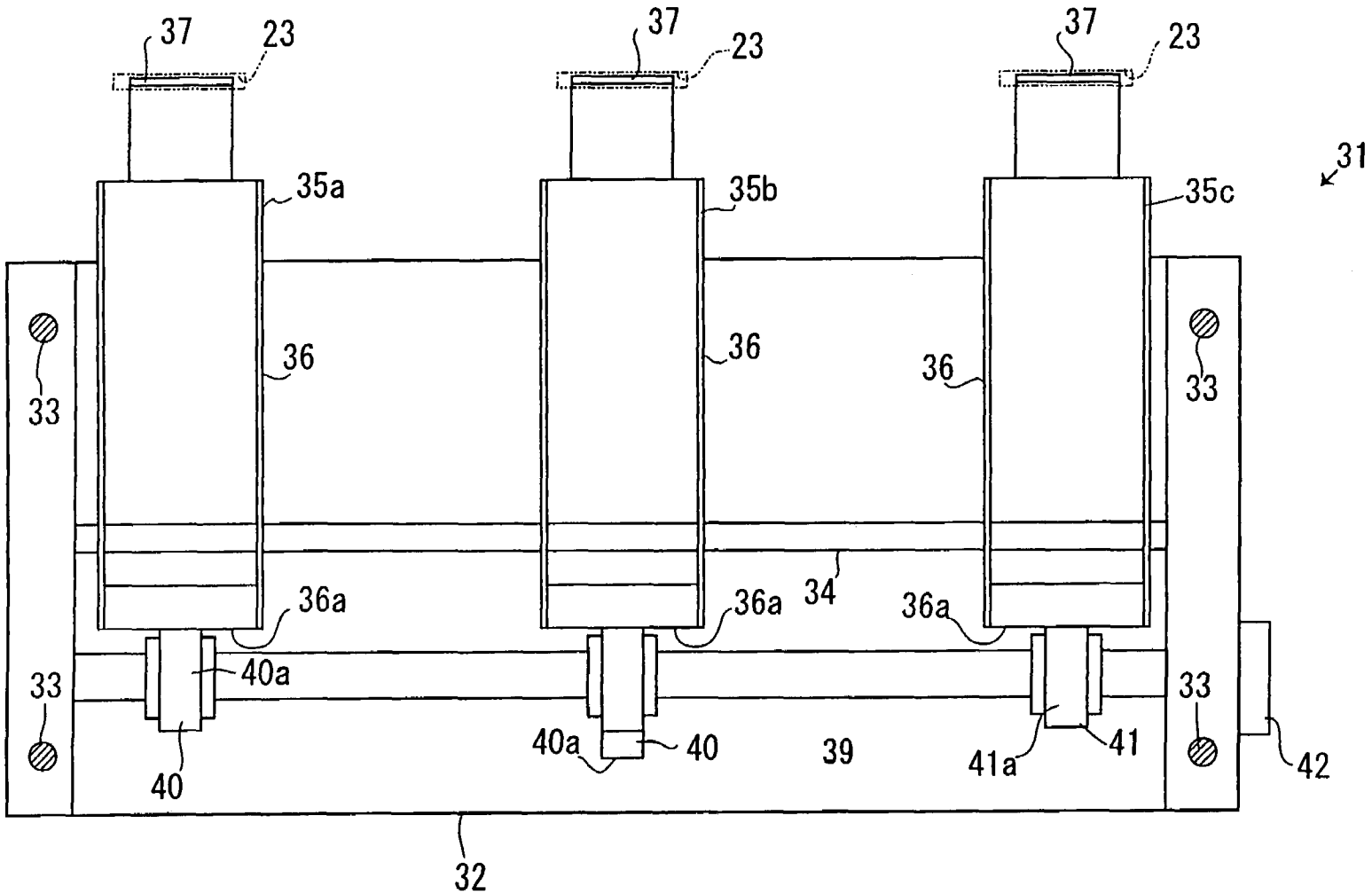
FIG. 4 is a plan view of a card reversing device of the embodiment.

As shown in FIGS. 2 to 4, reversing devices 31 for reversing cards are disposed on the rear surface of the table 19 corresponding to the through holes 23 and at rear surface positions corresponding to the two pairs of the guide plates 21. Each of the card reversing devices 31 is attached to the rear surface of the table 19 by coupling pins 33 through a bracket 32 constituting a part thereof. A first arm 35*a*, a second arm 35*b*, and a third arm 35*c* are supported by the bracket 32 through an arm shaft 34. The respective arms 35*a* to 35*c* are disposed at the same pitch as the pitch of the through holes 23.

Push-out plates 37 are integrally formed at tip ends of the respective arms 35*a* to 35*c*. The push-out plates 37 are extended upward from barrels 36 of the respective arms 35*a* to 35*c*. Each of the push-out plates 37 is formed to be curved. The bracket 32 and the barrel 36 of each of the arms 35*a* to 35*c* are coupled by a spring 38. By the elastic force of the spring 38, in FIGS. 5A to 5C and FIGS. 6A to 6C, each of the arms 35*a* to 35*c* is always urged in the counterclockwise direction around an arm shaft 34. A cam shaft 39 is rotatably supported at an area of the bracket 32 below the barrel 36. As shown in FIG. 4 and FIGS. 5A to 5C, constant speed cams 40 are fitted to the cam shafts 39 at areas opposite to rear end faces 36*a* of the barrels 36 of the first arm 35*a* and the second arm 35*b*. Besides, as shown in FIGS. 6A to 6C, a variable speed cam 41 is fitted to an area of the cam shaft 39 opposite to a rear end face 36*a* of the barrel 36 of the third arm 35*c*.

Figure 5:
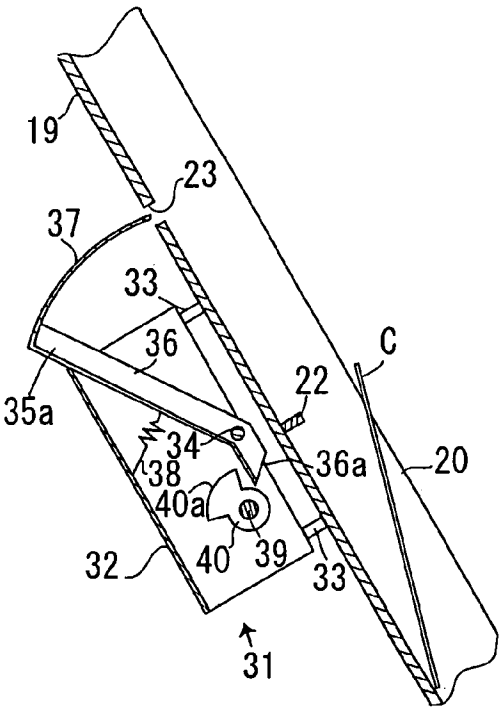
FIG. 5A is a side sectional view of the card reversing device showing a standby state of a constant speed cam of the embodiment.
FIG. 5B is a side sectional view of the card reversing device showing a state in which the constant speed cam is rotated to push up an arm.
FIG. 5C is a side sectional view of the card reversing device showing a state in which the constant speed cam is further rotated from the state of FIG. 5B and engagement with the arm is released.
Figure 5:
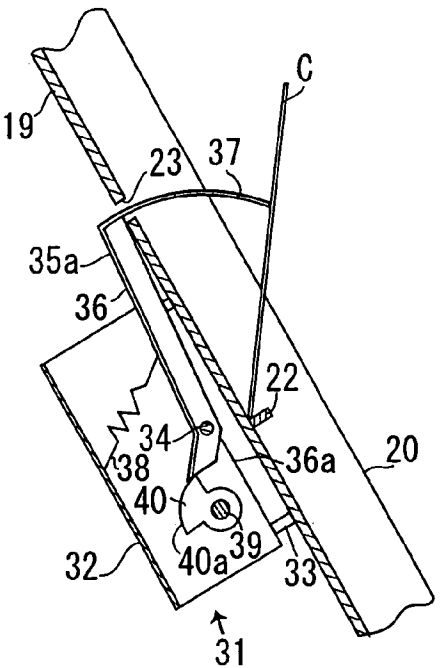
Figure 5:
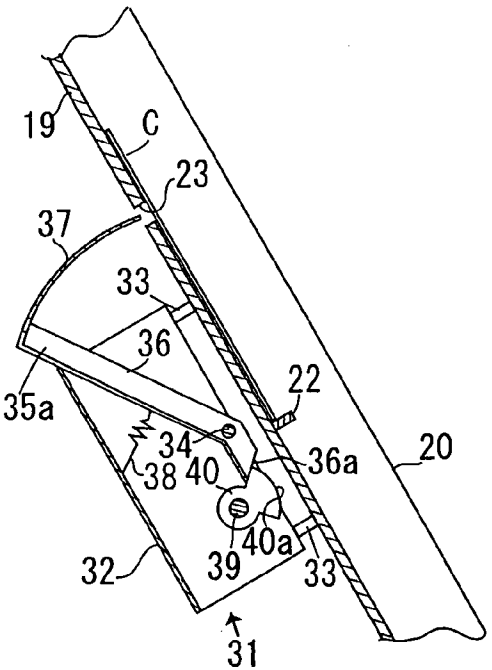
Figure 6:
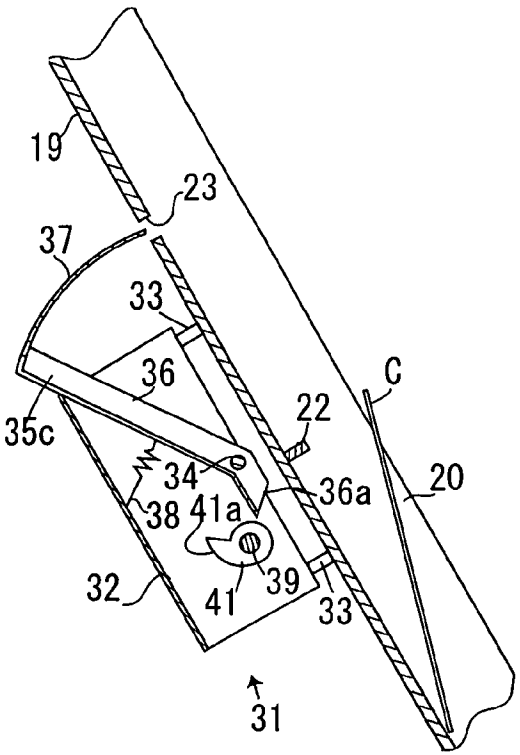
FIG. 6A is a side sectional view of the card reversing device showing a standby state of a variable speed cam of the embodiment.
FIG. 6B is a side sectional view of the card reversing device showing a state in which the variable speed cam is rotated to push up an arm.
FIG. 6C is a side sectional view of the card reversing device showing a state in which the variable speed cam is further rotated from the state of FIG. 6B and engagement with the arm is released.
Figure 6:
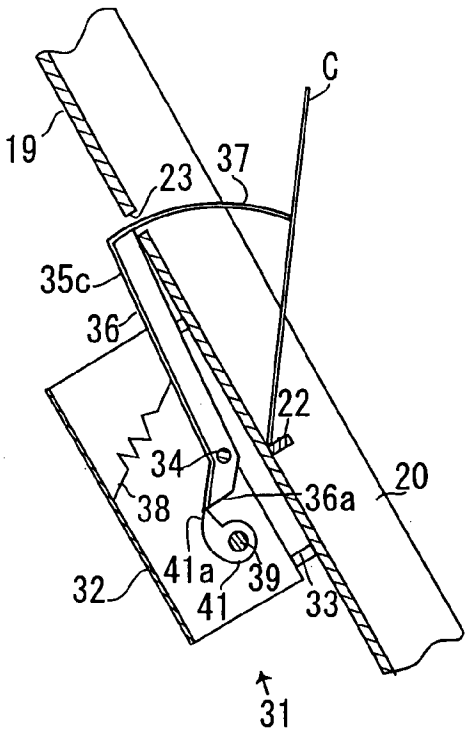
Figure 6:
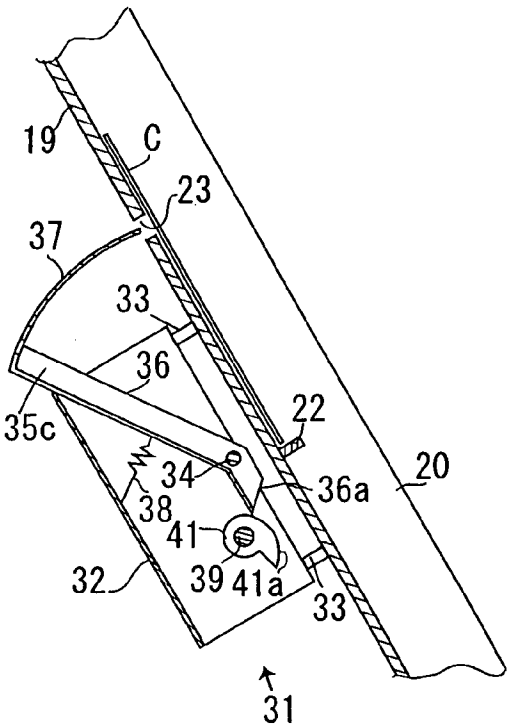

As shown in FIGS. 5A to 5C, with respect to each of the constant speed cam 40 interfering with the first arm 35*a* and the constant speed cam 40 interfering with the second arm 35*b*, a radius distance from the rotation center to a press surface 40*a* is always constant. As shown in FIG. 4, both the constant speed cams 40 are fitted to the cam shaft 39 while the phases of the press surfaces 40*a* are shifted little by little. Besides, as shown in FIGS. 6A to 6C, the variable speed cam 41 interfering with the third arm 35*c* is different from the other constant speed cams 40, and its radius distance from the rotation center to a press surface 41*a* becomes gradually long. In this embodiment, the distance from the center of the variable speed cam 41 to the longest area of the press surface 40*a* is made equal to the distance between the center of the constant speed cam 40 and the press surface 40*a*.

As shown in FIG. 4, a motor 42 is coupled to one end of the cam shaft 39. The cam shaft 39 is integrally rotated according to the rotation of the motor 42. As shown in FIGS. 5A to 5C and FIGS. 6A to 6C, when the motor 42 is rotated, the press surfaces 40*a* and 41*a* of the respective cams 40 and 41 come in contact with rear end surfaces 36*a* of the barrels 36 of the arms 35*a* to 35*c* and press them. When the rear end faces 36*a* of the barrels 36 are pressed by the press surfaces 40*a* and 41*a* of the respective cams 40 and 41, the barrels are rotated in the clockwise direction in the drawing against the elastic forces of the springs 38, and the push-out plates 37 are exposed at the upper surface of the table from the through holes 23. In the case where the contact between each of the rear end surfaces 36*a* of the barrels 36 and each of the press surfaces 40*a* and 41*a* is released, the barrels are instantaneously returned to the original positions by the elastic forces of the springs 38 (FIG. 5A, 6A).

As shown in FIGS. 2 and 3, a guide groove 51 extending in the horizontal direction is formed at a lower part of the surface of the table 19. A card collecting device 52 is disposed below the table 19. A guide rail 53 constituting a part of the card collecting device 52 is attached to the base 54. A motor 55 is attached to the right end side of the guide rail 53, and a drive pulley 56 is axially fitted to a driving shaft of the motor 55. A follower pulley 57 is disposed at the left end side of the guide rail 53. A belt 58 is stretched between both the pulleys 56 and 57. A collection plate 60 is coupled to a part of the belt 58 through a coupling plate 59. The collection plate 60 is constituted by a base 60*a* and a collection part 60*b*, and is formed to be substantially L-shaped when viewed from the front. Rollers 61 are attached to the rear surface of the base 60*a*. The respective rollers 61 are engaged with the guide rail 53. An engagement protrusion 62 is formed at the rear side of the collection part 60*b* of the collection plate 60, and the engagement protrusion 62 is engaged in the guide groove 51. According to the driving of the motor 55, the collection plate 60 is moved along the guide rail 53 between position A indicated by a solid line of FIG. 3 and position B indicated by a chain double-dashed line.

As shown in FIGS. 2 and 3, a card distributing device 70 is disposed above the table and on the base 54. The card distributing device 70 is constructed of a guide rail 71 and a distribution carrier 81. A motor 72 is fixed to the right end side of the guide rail 71, and a driving pulley 73 is fixed to a driving shaft of the motor 72. A follower pulley 74 is disposed at the left end side of the guide rail 71. A distributing belt 75 is stretched between both the pulleys 73 and 74.

As shown in FIGS. 3 and 7 to 13, guide rollers 82 of the distribution carrier 81 are engaged with the guide rail 71. The guide rollers 82 are attached to a body plate 84 through roller brackets 83. An interval between both side walls 84*a* and 84*b* of the body plate 84 is set slightly larger than the width of the card C used in this embodiment. A spring fixing plate 85 is attached to the center of the body plate 84. A loading plate 86 on which the card is placed is disposed above the spring fixing plate 85. The loading plate 86 is formed to be hook-shaped, and an engagement part 86*a* protrudes to an opposite surface through a movement hole 87 formed at the left wall 84*a* of the body plate 84.

Four conical coil springs 89 are disposed between a loading part 86*b* of the loading plate 86 and the spring fixing plate 85. The loading plate 86 is always urged upward by the springs 89. A pair of front and back shafts 90 and 91 are rotatably supported above the loading plate 86 and between both the side walls 84*a* and 84*b* of the body plate 84. A pair of front and back motors 92 are fixed to the right side 84*b* of the body plate 84. The shafts 90 and 91 are respectively fixed to drive shafts of the respective motors 92. A pair of right and left supply rollers 93 are mounted to each of the shafts 90 and 91. Both the supply rollers 93 can be rotated integrally with the shafts 90 and 91. The loading part 86*b* of the loading plate 86 interferes with the supply rollers 93, so that upward movement to the loading plate 86 is restricted.

A pair of guide plates 94 are disposed at the left wall 84*a* of the body plate 84. The engagement part 86*a* of the loading plate 86 is disposed between both the guide plates 94. A rack 95 extending vertically is attached to the engagement part 86*a*. A motor 97 is attached to a lower surface of the body plate 84 through a bracket 96. A pinion gear 98 is fixed to a driving shaft of the motor 97. The gear 98 is engaged with the rack 95. A part of the pinion gear 98 is cut away, and a notch part 98*a* having no teeth is formed. In the state where the notch part 98*a* is opposite to the rack 95, the engagement relation with the rack 95 is released, and the loading plate 86 is raised by the elastic force of the coil spring 89 and is held in the state of FIGS. 9 and 10. Besides, in the case where the pinion gear 98 is rotated in the clockwise direction in FIG. 11 according to the driving of the motor, the gear 98 is engaged with the rack 95, the rack 95 is moved downward, and the loading plate 86 is lowered against the elastic force of the coil spring 89.

Figure 7:
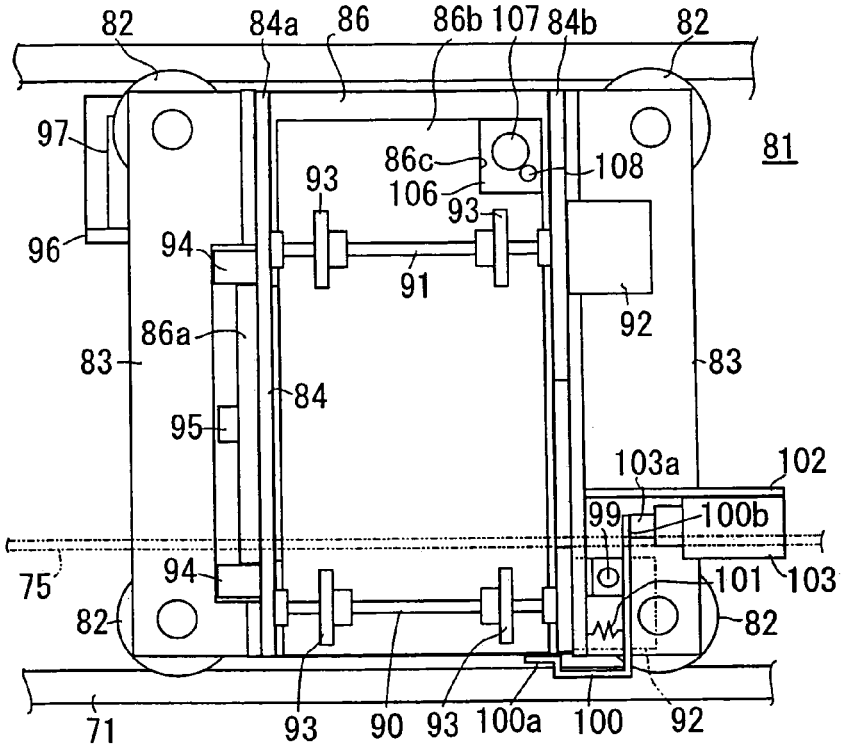
FIG. 7 is a plan view of a lever closing state of a distribution carrier of the embodiment.

In FIG. 7, an upper right corner of the loading part 86*b* is a cut-out notch part 86*c*. A sensor unit 106 is fixed to the notch part 86*c*. A CCD camera 107 and an LED (Light-Emitting Diode) 108 are fixed to the sensor unit 106.

Figure 9:
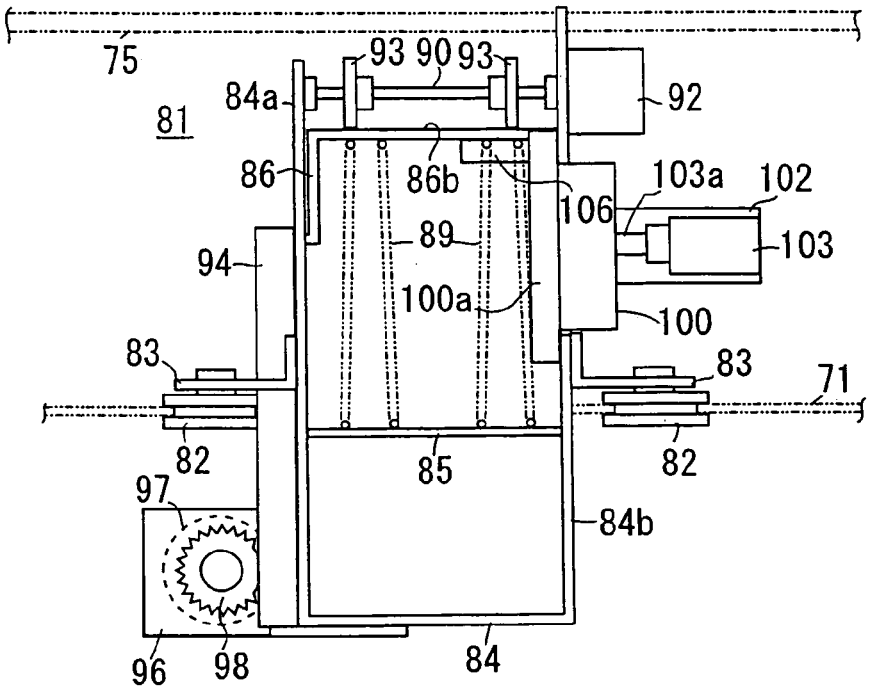
FIG. 9 is a front view of a state in which a loading plate of the distribution carrier of the embodiment is raised.
Figure 10:
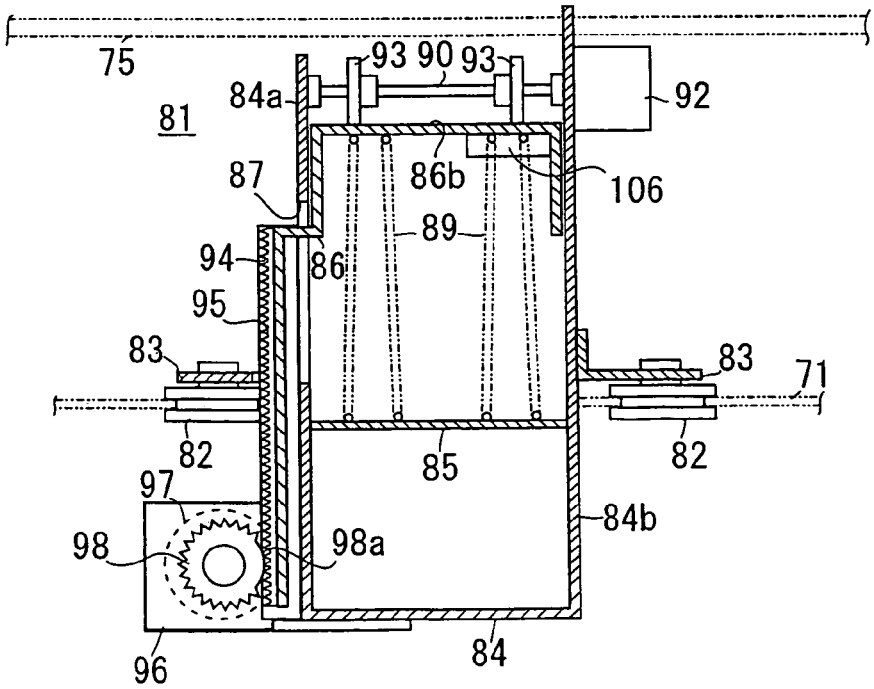
FIG. 10 is a front sectional view of the state in which the loading plate of the distribution carrier of the embodiment is raised.
Figure 11:
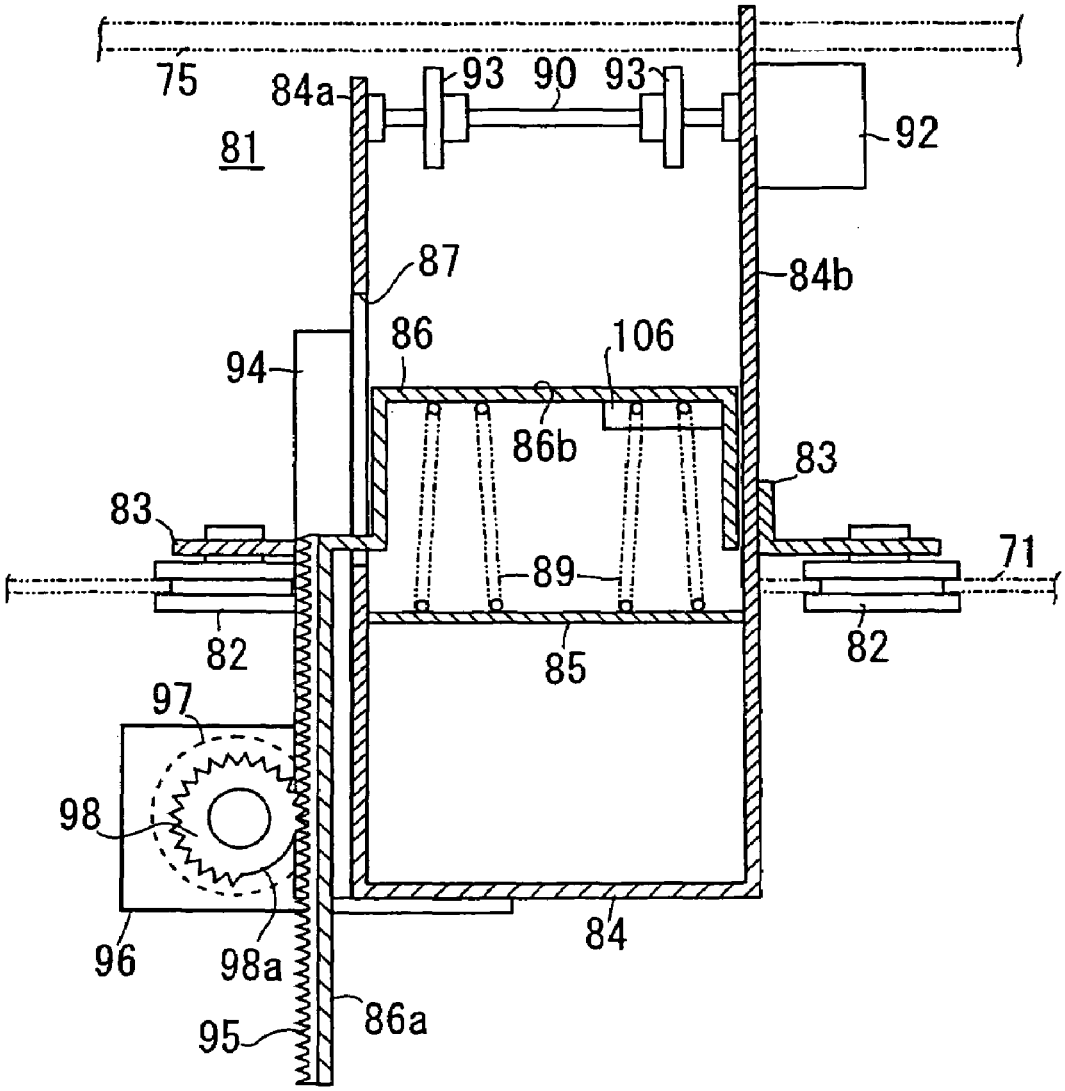
FIG. 11 is a front sectional view of a state in which the loading plate of the distribution carrier of the embodiment is lowered.
Figure 12:
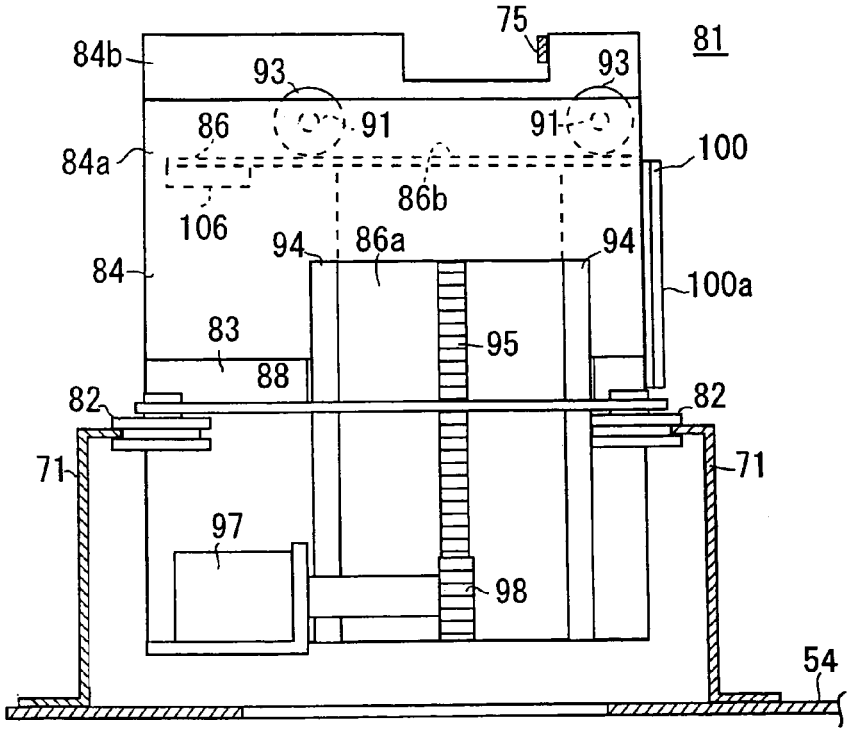
FIG. 12 is a side view of the distribution carrier of the embodiment.
Figure 13:
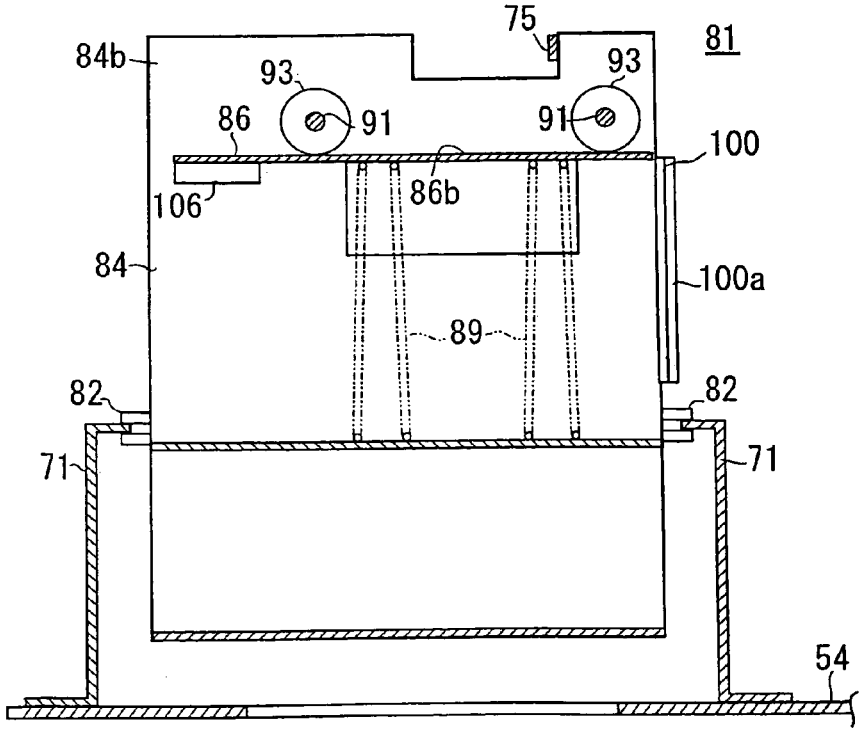
FIG. 13 is a side sectional view of the distribution carrier of the embodiment.

As shown in FIGS. 7 and 9, a substantially L-shaped lever 100 is rotatably supported to the right wall 84*b* of the body plate 84 through a shaft 99. A press surface 100*a* of the lever 100 is opposite to a front end face of the loading plate 86, and its upper end is set to be slightly lower than the loading part 86*b* of the loading plate 86. The right wall 84*b* of the body plate 84 and the lever 100 are coupled to each other through a spring 101, and the lever 100 is always urged in the clockwise direction in FIG. 7 by the elastic force of the spring 101. A solenoid 103 is attached to the right side wall 84*b* of the body plate 84 through a bracket 102. In the case where the solenoid 103 is in a non-excitation state, as shown in FIG. 7, a rod 103*a* is in a contracted state, and the press surface 100*a* of the lever 100 is held in a state where it faces the front surface of the loading plate 86.

Figure 8:
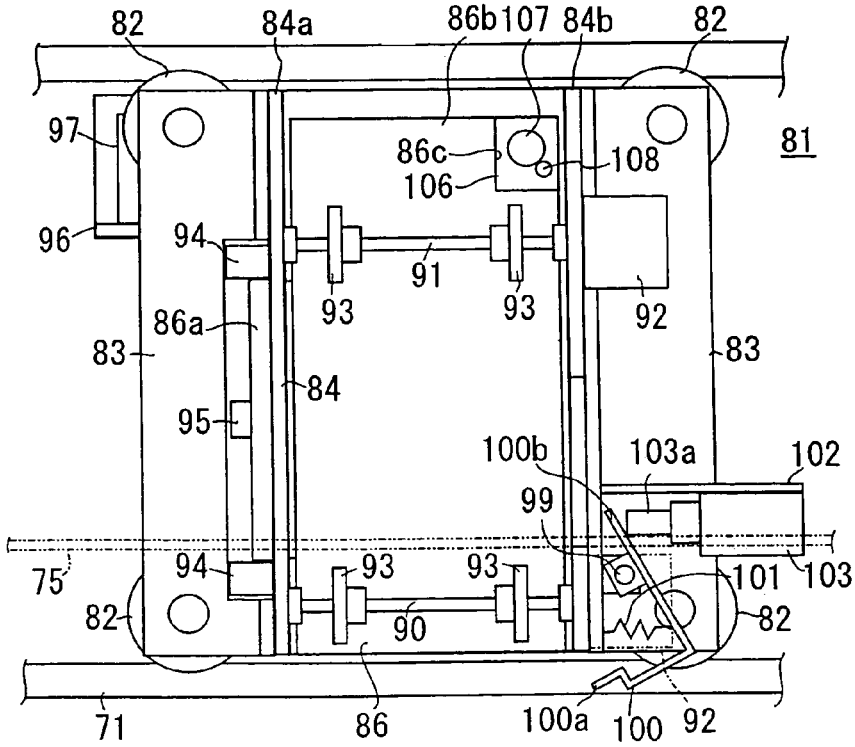
FIG. 8 is a plan view of a lever opening state of the distribution carrier of the embodiment.

On the other hand, in the case where the solenoid 103 is in an excitation state, as shown in FIG. 8, the rod 103*a* is in an expanded state, and a working surface 100*b* of the lever 100 is pressed by the rod 103*a* so that the facing relation between the press surface 100*a* of the lever 100 and the front end face of the loading plate 86 is released. As shown in FIGS. 9 to 13, the distributing belt 75 is coupled to the upper part of the right side wall 84*b* of the body plate 84. The distribution carrier 81 is moved along the guide rail 71 between two positions, that is, position C and position D of FIG. 3 according to the driving of the motor 92. As shown in FIG. 3, a sensor 105 for detecting the position of the distribution carrier 81 relative to the table is fitted to the guide rail 71. As shown in FIG. 1, the distribution carrier 81 is disposed outside of the frame of the window 13*a*, and the distribution carrier 81 is always shielded by the frame part of the exhibition part 13 and is not seen from the outside.

Figure 14:
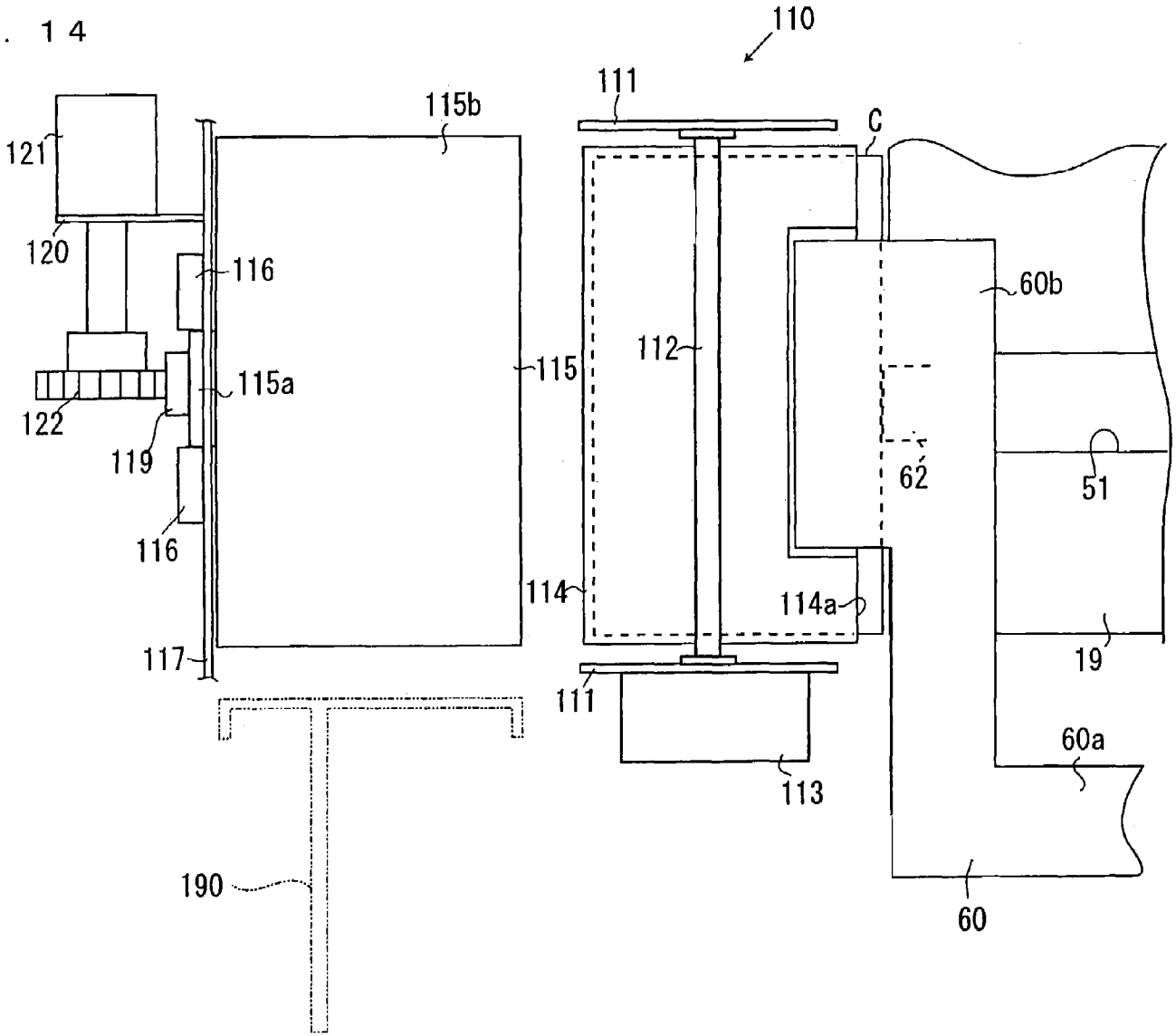
FIG. 14 is a plan view of a card accommodating device of the embodiment.
Figure 15:
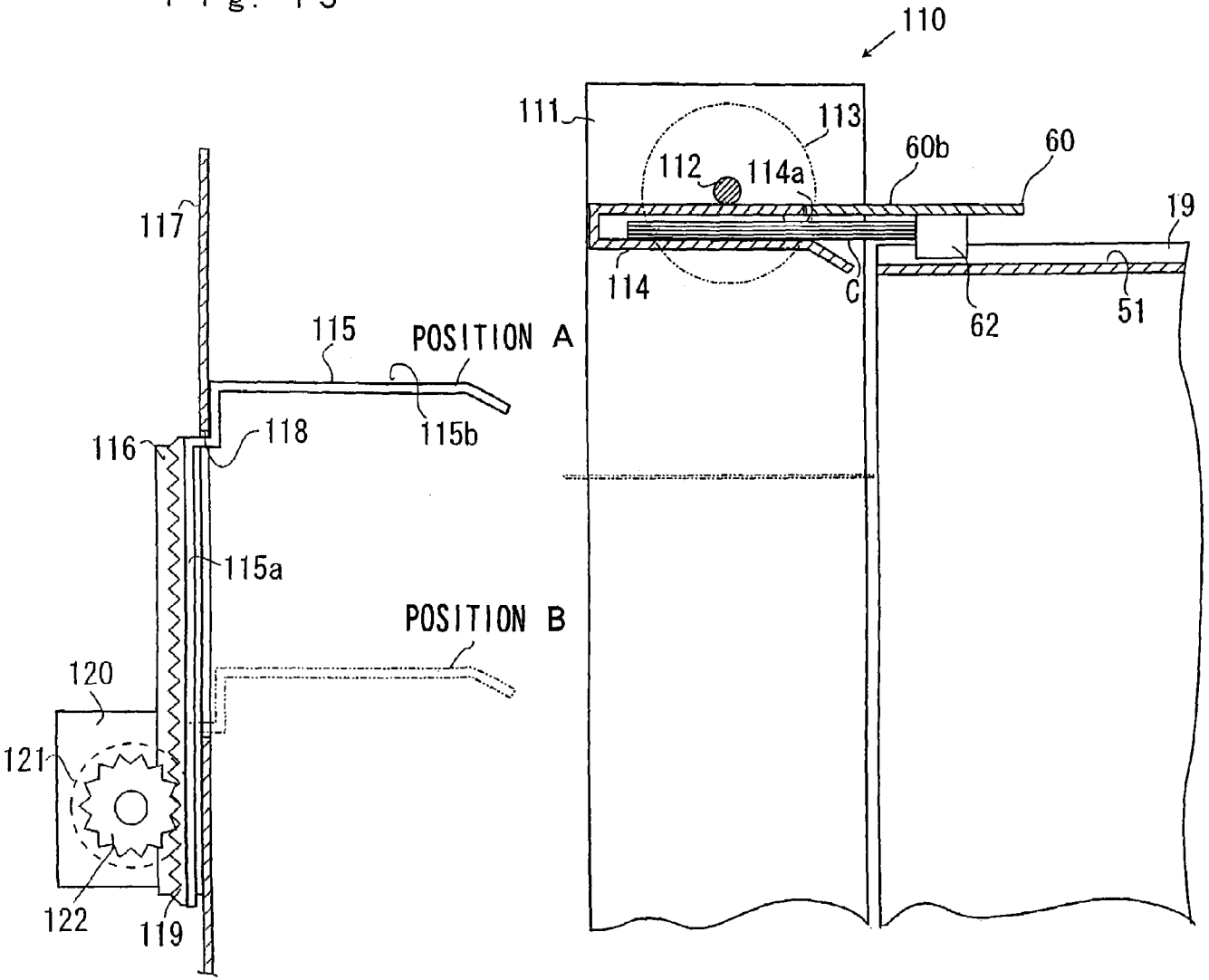
FIG. 15 is a side sectional view of the card accommodating device of the embodiment.

As shown in FIGS. 3 and 14, an accommodating device 110 for accommodating cards is disposed at the left of the guide groove 51. As shown in FIGS. 14 and 15, a shaft 112 is rotatably supported between a pair of support plates 111 constituting the accommodating device 110. An accommodation motor 113 is fixed to the lower support plate 111, and the shaft 112 is axially fitted to the motor 113. An accommodation box 114 is fixed to the shaft 112 to be integrally rotatable. A side of the accommodation box 114 opposite to the guide groove 51 is an opening part 114*a*, and the opening part 114*a* is opposite to the engagement protrusion 62 of the collection plate 60. The accommodation box 114 is rotated and moved between two positions, that is, a card accommodation position of FIG. 15 and a card discharge position of FIG. 16 according to the driving of the accommodation motor 113. As shown in FIGS. 14 and 15, a side plate 117 is disposed at the left of the accommodation box 114. A pair of right and left guide plates 116 are attached to the side plate 117. A through hole 118 vertically opening is formed between the guide plates 16, and an engagement part 115*a* of the loading plate 115 is exposed at the opposite side of the side plate 117 through the through hole 118. A rack 119 is attached to the engagement part 115*a* of the loading plate 115. A motor plate 120 is coupled to the lower part of the side plate 117, and a motor 121 is attached to the motor plate 120. A pinion gear 122 is fixed to a driving shaft of the motor 121. The pinion gear 122 is engaged with the rack 119. As a result, the loading part 115*b* of the loading plate 115 can be moved up and down between position A and position B of FIG. 15 according to the driving of the motor 121.

Figure 17:
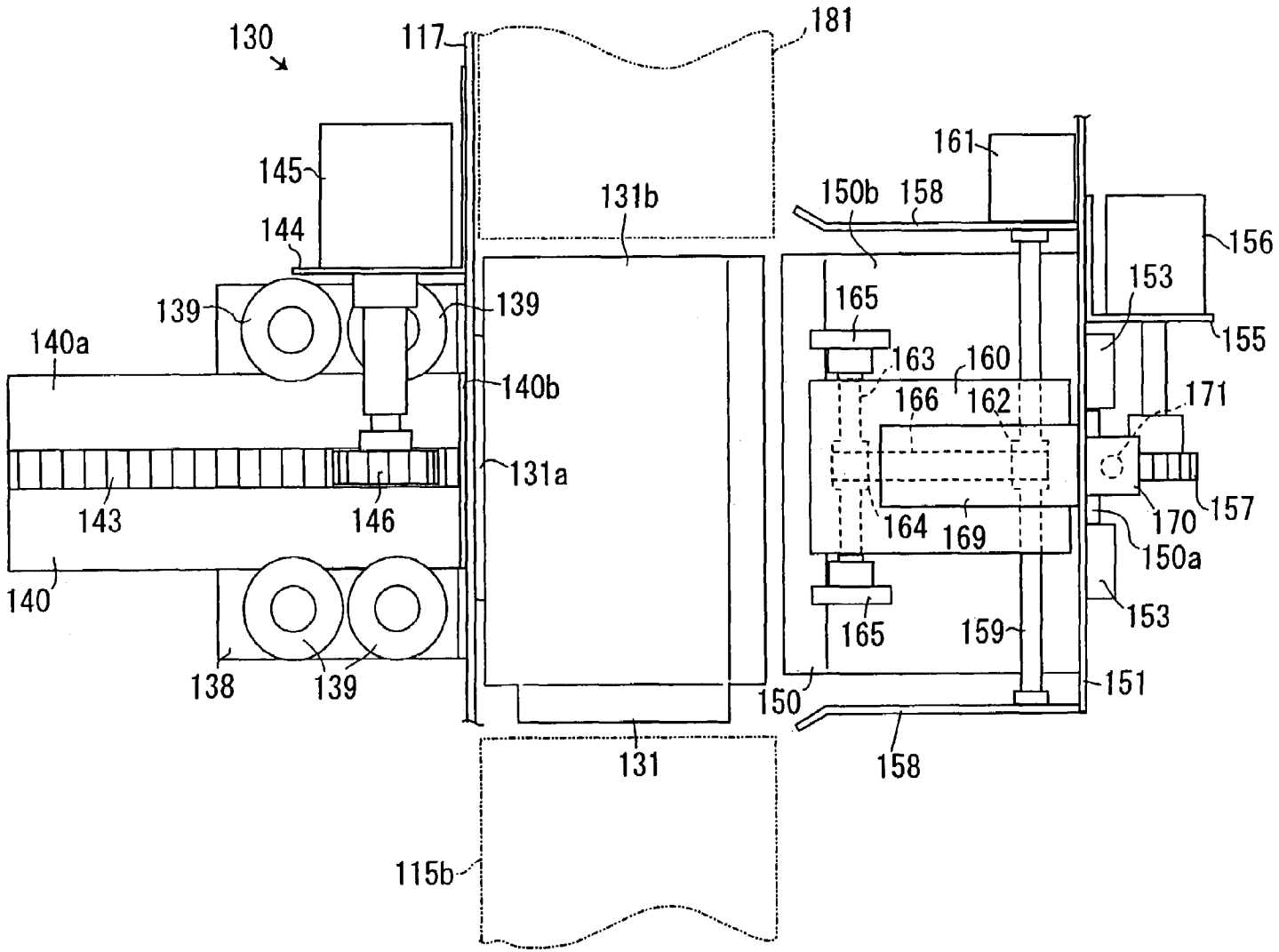
FIG. 17 is a plan view of a shuffle device of the embodiment.

As shown in FIGS. 3 and 17, a shuffle device 130 is disposed above the accommodating device 110. The shuffle device 130 includes, as main parts, a feed side loading plate 131, a push-out plate 140, a reception side loading plate 150, motors 136, 144, 155, 161, and the like, and has a function to reshuffle the collected cards.

Figure 18:
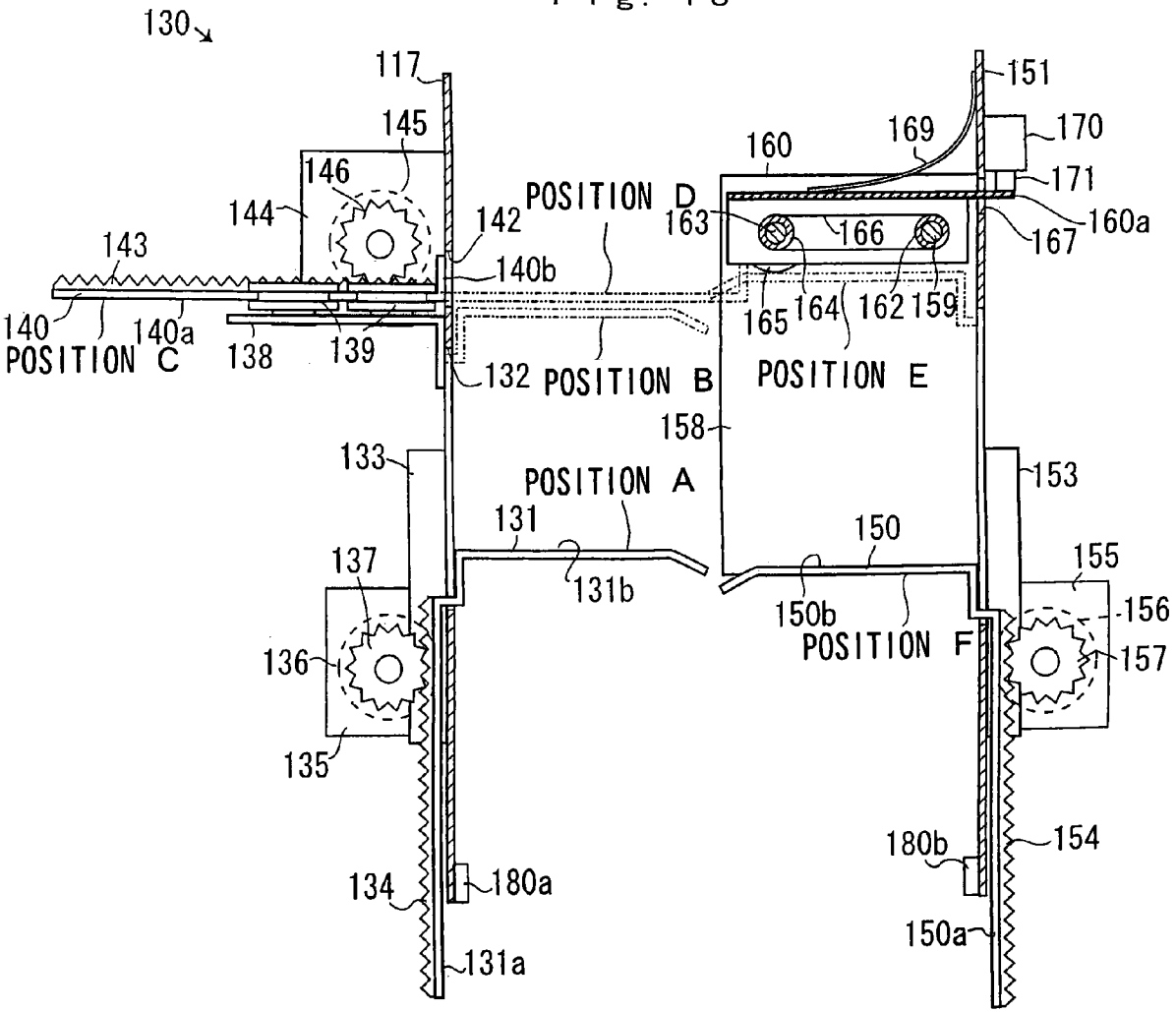
FIG. 18 is a front sectional view of the shuffle device of the embodiment in which a tilt plate is in a horizontal state.

As shown in FIG. 18, a support part 131*a* of the feed side loading plate 131 is exposed at the opposite side of the side plate 117 through a through hole 132 of the side plate 117. The support part 131*a* is moved up and down along a pair of right and left guide plates 133 coupled to the side plate 117. A rack 134 is coupled to the support part 131*a* of the feed side loading plate 131. The motor 136 is coupled to the side plate 117 through a motor plate 135. A pinion gear 137 is fitted to a driving shaft of the motor 136. The pinion gear 137 is engaged with the rack 134. As a result, a loading part 131*b* of the feed side loading plate 131 can be moved up and down between position A and position B of FIG. 18 according to the driving of the motor 136. A sensor 180*a* for detecting the height of the loading part 131*b* relative to the side plate 117 is attached to an area of the side plate 117 below the loading part 131*b* of the feed side loading plate 131. Besides, a sensor 180*b* for detecting the height of a loading part 150*b* relative to a side plate 151 is attached below the loading part 150*b* of the reception side loading plate 150.

As shown in FIGS. 17 and 18, a roller support plate 138 is coupled to an area of the side plate 117 above the guide plate 133. Four guide rollers 139 are rotatably supported on the upper surface of the roller support plate 138. A guide part 140*a* of the push-out plate 140 is engaged with the guide rollers 139. A push-out part 140*b* bent at right angles to the guide part 140*a* and opposite to a through hole 142 of the side plate 117 is formed in the push-out plate 140. A rack 143 is coupled to the upper surface of the guide part 140*a*. A motor 145 is coupled to a part of the side plate 117 above the push-out plate 140 through a motor plate 144. A pinion gear 146 is fitted to a driving shaft of the motor 145. The pinion gear 146 is engaged with the rack 143. The push-out plate 140 can be moved horizontally between two positions, that is, position C and position B of FIG. 18 according to the driving of the motor 145.

As shown in FIGS. 17 and 18, a support part 150*a* of the reception side loading plate 150 protrudes to the opposite side from a through hole 152 of the right side plate 151. The support part 150*a* is disposed between a pair of right and left guide plates 153 coupled to the side plate 151. A rack 154 is attached to the support part 150*a* of the reception side loading plate 150. A motor 156 is coupled to the side plate 151 through a motor plate 155. A pinion gear 157 is axially fitted to the motor 156. The pinion gear 157 is engaged with the rack 154. The loading part 150*b* of the reception side loading plate 150 can be moved up and down between position E and position F of FIG. 18 according to the driving of the motor 156.

A pair of right and left support plates 158 are fixed to the side plate 151. A driving side shaft 159 is rotatably supported between both the support plates 158. A bracket 160 is rotatably supported through the shaft 159. A driving shaft of a feed motor 161 fixed to the upper support plate 158 is fitted to one end side of the driving side shaft 159. A driving pulley 162 is fitted to the center of the driving side shaft 159 to be integrally rotatable. A follower side shaft 163 is rotatably supported to the left of the bracket 160. A follower pulley 164 is fitted to the center of the shaft 163 to be integrally rotatable. Rollers 165 are fitted to both ends of the follower side shaft 163 to be integrally rotatable. A belt 166 is stretched between the driving pulley 162 and the follower pulley 164. The rollers 165 are rotated in the clockwise direction or the counterclockwise direction in FIG. 18 according to the driving of the feed motor 161.

Figure 19:
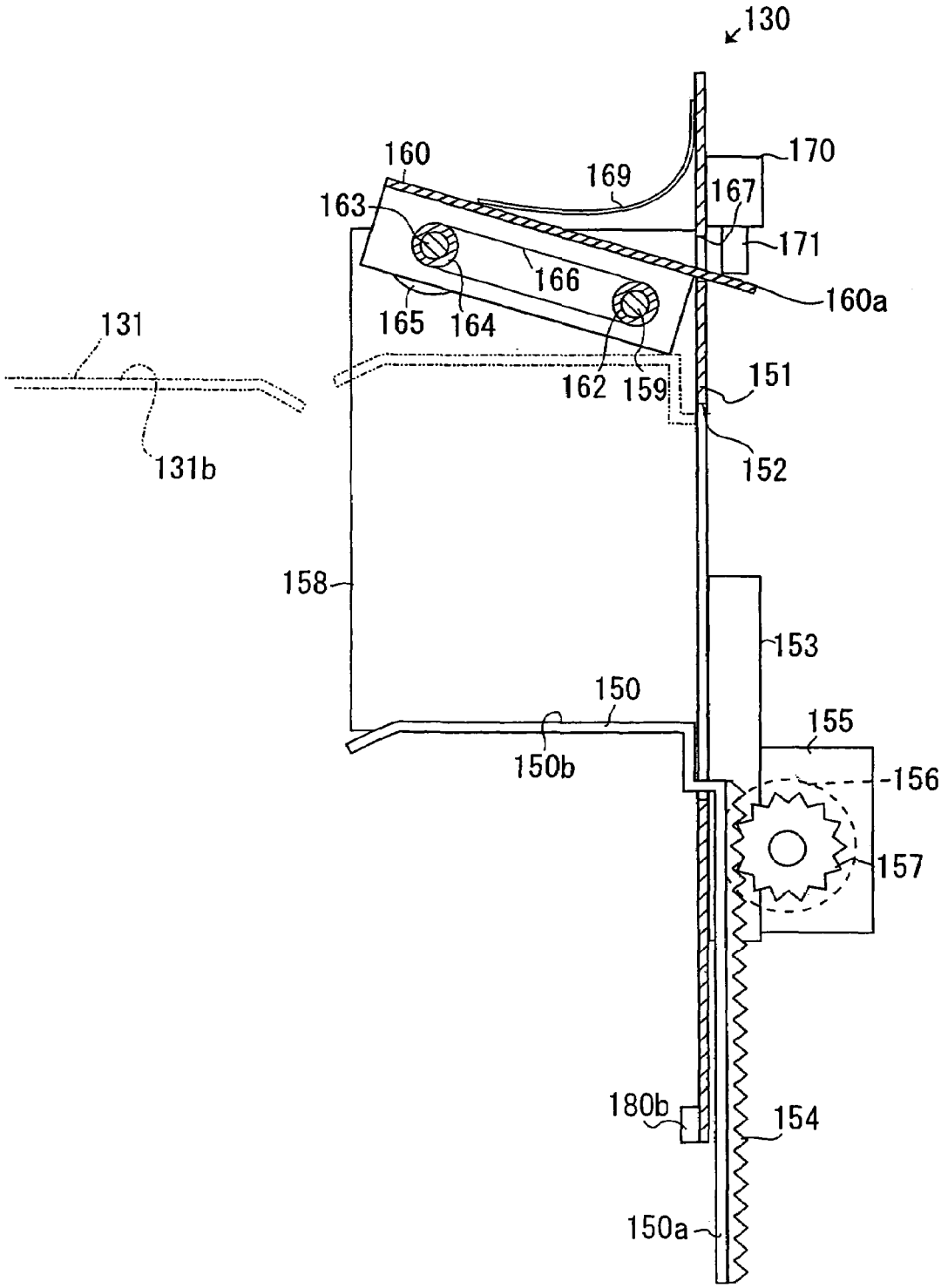
FIG. 19 is a front sectional view of the shuffle device of the embodiment in which the tilt plate is in a tilt state.

A protrusion 160*a* protruding from a through hole 167 of the side plate 151 to the opposite surface is formed at the right side part of the bracket 160. A solenoid 170 is attached to a part of the side plate 151 above the protrusion part 160*a*. An upper surface of the bracket 160 is pressed by a plate spring 169 fixed to the side plate 151, and the bracket 160 is always urged by the elastic force of the spring 169 in the counterclockwise direction around the driving side shaft 159. At the time of contraction of a rod 171 of the solenoid 170, the bracket 160 is held in the horizontal state shown in FIG. 18. At the time of expansion of the rod 171, the protrusion part 160*a* is pressed by the rod 171, and the bracket 160 is held in a tilt state shown in FIG. 19.

Figure 20:
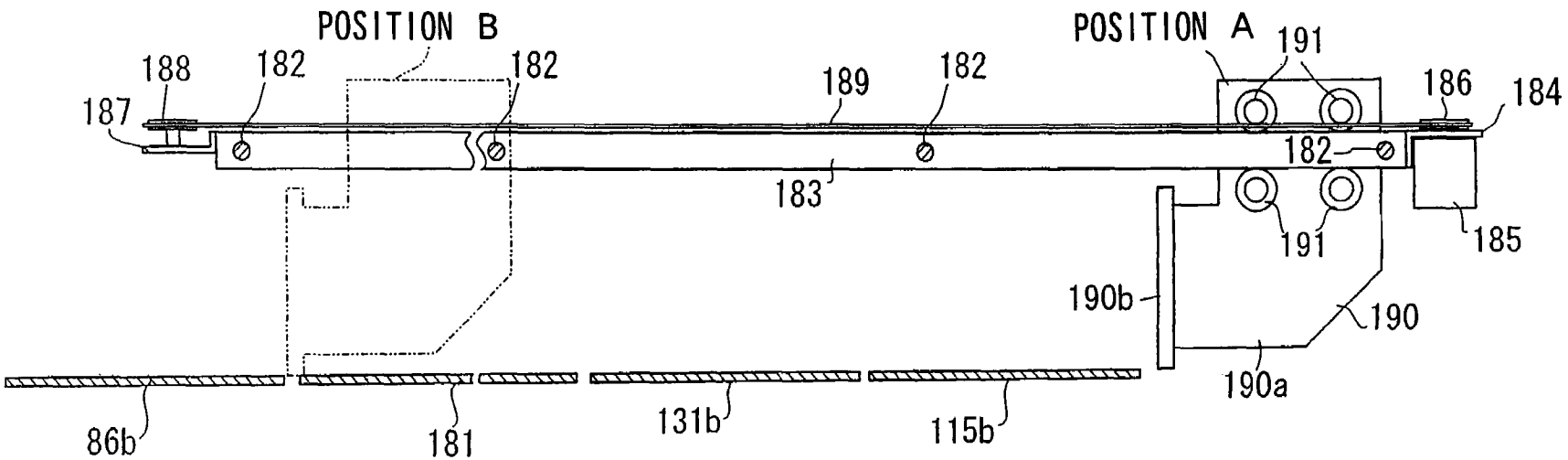
FIG. 20 is a side view showing a movement locus of a delivery plate of the embodiment.

As shown in FIGS. 3 and 20, a relay plate 181 is disposed between the shuffle device 130 and the card distributing device 70. A guide rail 183 is supported by the side plate 117 through pins 182, and a motor support plate 184 is attached to one end face of the guide rail 183. A motor 185 is supported by the plate 184, and a driving pulley 186 is fitted to a driving shaft of the motor 185. A pulley plate 187 is attached to the other end side of the guide rail 183. A follower pulley 188 is fitted to the pulley plate 187. A delivery belt 189 is stretched between the driving pulley 186 and the follower pulley 188.

A delivery plate 190 is engaged with the guide rail 183 through guide rollers 191, and a push-out part 190*b* is coupled to the front part of a barrel 190*a* of the delivery plate 190. The push-out part 190*b* has almost the same width as the card C, and its height is made slightly taller than the height of four sets of cards (1 set=52 cards except the joker). The delivery belt 189 is coupled to the barrel 190*a* of the delivery plate 190. As a result, the delivery plate 190 can be moved reciprocally between position A and position B of FIG. 20 according to the driving of the motor 185. At the time of movement of the delivery plate 190, the push-out part 190*b* is moved while it is in slight contact with the upper surfaces of the loading part 115*b* of the loading plate 115 of the accommodation device 110, the loading part 131*b* of the feed side loading plate 131 of the shuffle device 130, and the relay plate 181.

Next, the operation of this embodiment will be described. The game machine 11 is drive controlled by a not-shown controller on the basis of a previously set program.

Figure 21:
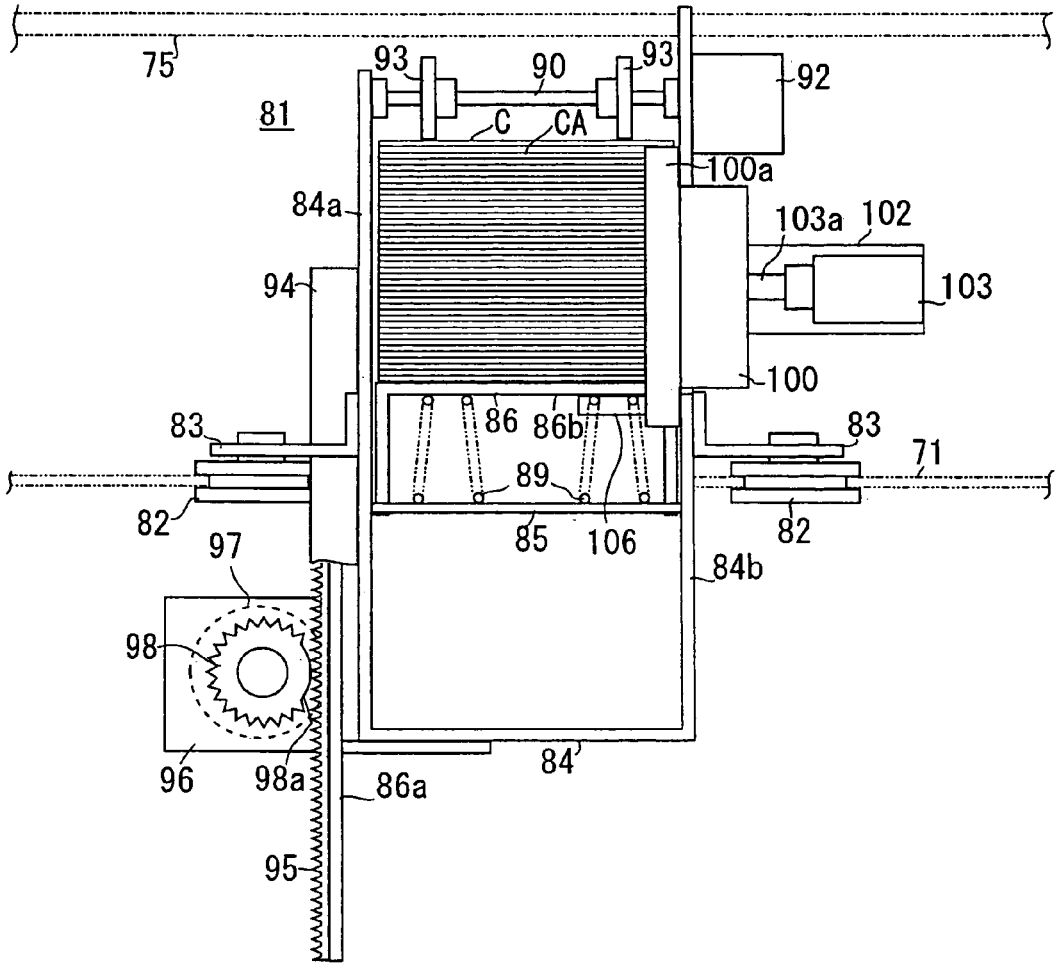
FIG. 21 is a front view of the distribution carrier of the embodiment on which cards are placed.

The distribution carrier 81 is on standby at the position D of FIG. 3 during game standby. As shown in FIG. 21, many cards C as a card group CA (four sets of cards in this embodiment) in a state where they are placed face down, are held in a stacked state between the loading part 86*b* of the loading plate 86 and the supply rollers 93. At this time, since the notch part 98*a* of the pinion gear 98 is held in a state where it faces the rack 95, all cards C are held between the loading part 86*b* and the supply rollers 93 by the elastic force of the coil spring 89. The solenoid 103 is held in the non-excitation state, and the lever 100 is held in a state where it faces the end face of the loading part 86. By this, even if the card group CA held between the loading part 86*b* and the supply rollers 93 are forced to slide down forward by their own weights, they are pressed by the press part 100*a* of the lever 100, and it is possible to prevent the cards C from jumping out from the distribution carrier 81. In this embodiment, as shown in FIG. 20, the four sets of cards C are placed as a next card group CB on the loading part 131*b* of the feed side loading plate 131 of the shuffle device 130. The next card group CB are made to stand by in the vicinity of the distribution carrier 81 so that the game is not interrupted at a stage where the previous card group CA are used up in the game.

In this embodiment, an example in which the invention is applied to a baccara game will be described. The baccara game is played such that the entries for the game are divided into a banker (the game machine 11 side) and each player, and expectations are made as to victory or default, that is, as to whether a winner of the game is the banker or the player, or the game ends in a draw. The description of the detailed contents of the baccara game will be omitted in this embodiment.

Figure 22:
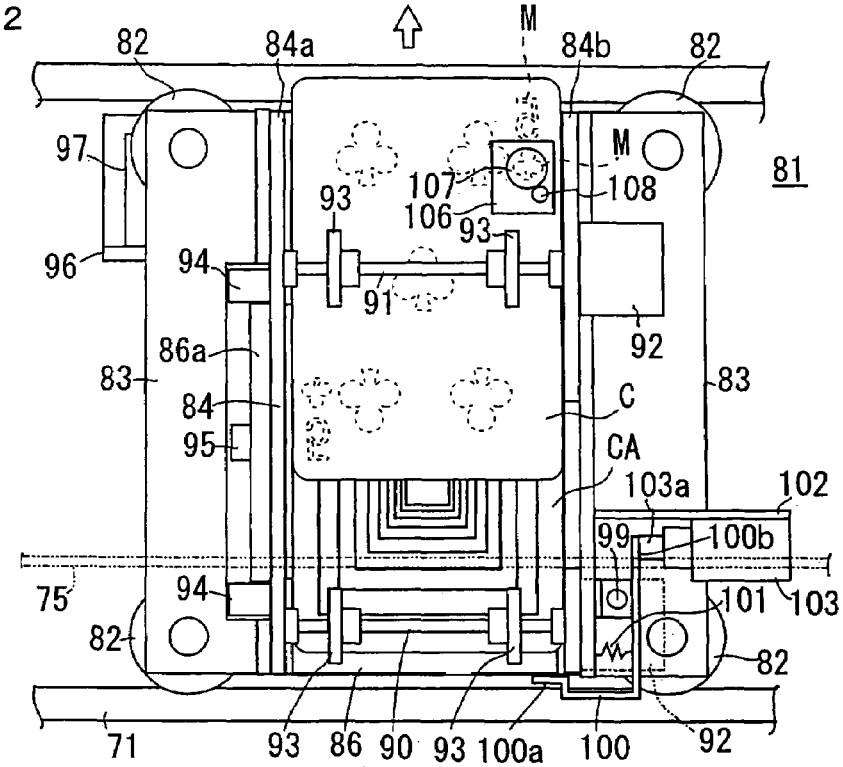
FIG. 22 is a plan view of the distribution carrier of the embodiment at the time of readout of a mark of a card.

When the game is played, first, the player expects the result of the game, and inputs desired marks and numerals on the monitor 14 by the operation of the buttons 18 of the operation panel 15. When the input of the marks and numerals is ended, the motor 72 of the card distributing device 70 is driven, and the distribution carrier 81 is moved in the direction of the position C of FIG. 3 along the guide rail 71. When the distribution carrier is moved to the upper position corresponding to the space S1, the driving of the motor 72 is stopped and the distribution carrier 81 is stopped at that position. When the distribution carrier 81 is stopped, the motor 92 is driven in the reverse rotation direction. That is, as shown in FIG. 22, the uppermost card C is moved upward by the rotation of the supply rollers 93, a mark (numeral and mark such as clubs or diamonds) M at the right corner part of the uppermost card C passes through the CCD camera 107 of the sensor unit 106, and the mark M of the card C is identified by the CCD camera 107. At this time, by the illumination from the LED 108, the CCD 107 can certainly identify the mark M of the card C also at the rear surface of the card C on which the outer light does not impinge. The mark M of the card C identified by the sensor unit 106 is stored by the controller.

Figure 23:
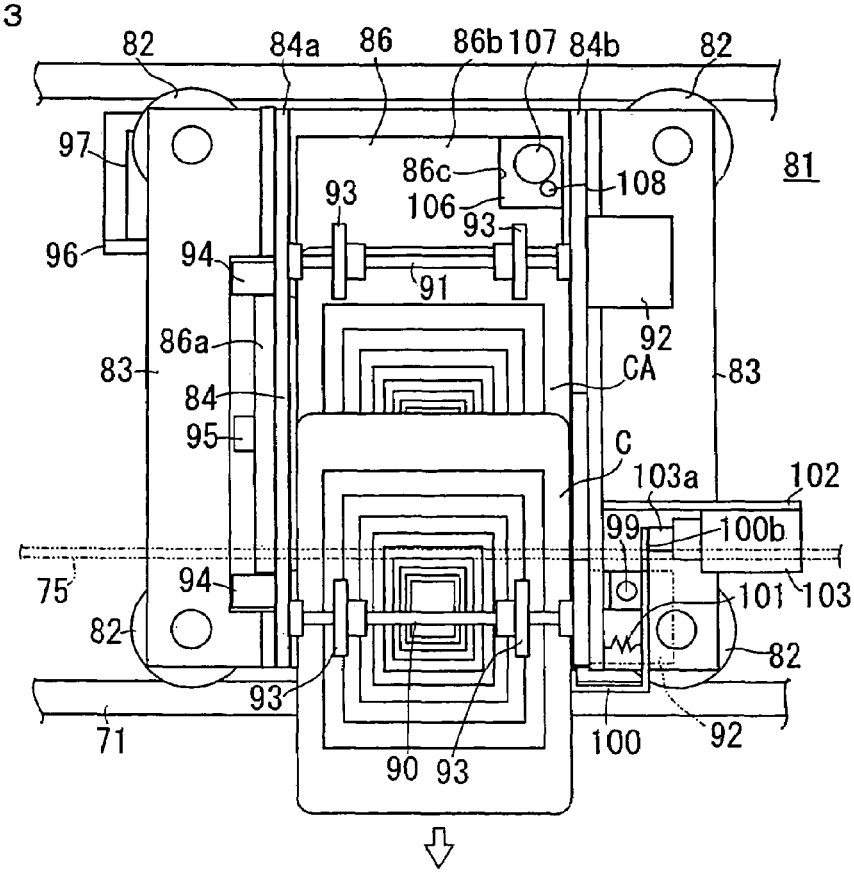
FIG. 23 is a plan view of the distribution carrier of the embodiment at the time of card distribution.

When the identification of the mark M of the card C is ended, the motor 92 is driven in the positive rotation direction, and as shown in FIG. 23, the supply roller 93 discharges the uppermost card C from the distribution carrier 81 onto the table 19. The card C discharged from the distribution carrier 81 is dropped and moved into the space S1 (position p of FIG. 2). The card C slides down in the space S1 along the guide plate 21, comes in contact with the stopper 22 and is once stopped (position q of FIG. 2). In this state, the distribution of the card C to the space S1 is ended.

Next, the motor 72 is again driven, and the distribution carrier 81 is moved to the position opposite to the adjacent space S2. Here, similarly to the above, after the mark of the uppermost card C is identified, the card C is distributed into the space S2. A similar operation is performed until the space S6. The controller stores the marks of all the distributed cards C. The controller compares the mark inputted by the player before the card C is distributed and the mark of the card C distributed lately, and makes a judgment as to victory or defeat of the game. Here, the controller does not yet notify the player of the result. Incidentally, the stop operations at the positions corresponding to the spaces S1 to S6 are performed such that the controller controls the driving of the motor 72 on the basis of the detection signals from the sensor 106.

Next, the motor 42 of the reversing device 31 is driven. As shown in FIGS. 5A to 5C and 6A to 6C, the cams 40 and 41 are rotated according to the driving of the motor 42, and press the rear end surfaces 36*a* of the barrels 36 of the arms 35*a* to 35*c*. The push-out plates 37 of the arms 35*a* to 35*c* are exposed at the surface of the table 19 from the through holes 23 of the table 19 by the press operation of the cams 40 and 41. At this time, the push-out plates are exposed at the surface of the table in sequence of the left arm 35*a*, the center arm 35*b*, and the right arm 35*c*. At this time, the push-out plate 37 of each of the arms 35*a* to 35*c* presses the upper position of the card C higher than the center part. The respective cards C are rotated around the ends, which come in contact with the stoppers 22, as the base points according to the pressing (states of FIGS. 5B and 6B, and position r of FIG. 2). When exceeding a predetermined rotation amount, the card C is separated from the stopper 22 by its own weight, and drops downward from the stopper 22 (FIG. 5C, FIG. 6C, and position s of FIG. 2). At this time, the respective cards C the rear surfaces of which are exposed are reversed, and the front surfaces on which the marks are depicted are exposed, so that the player can confirm the marks of the respective cards C. In this embodiment, although two pairs of the reversing device 31 are provided, both the reversing devices 31 are driven at the same timing. Of course, they may be driven at different timings.

The left arm 35*a* and the center arm 35*b* raise the cards C at the constant speed by the action of the constant speed cams 40, and reverse the same cards C. On the other hand, the right arm 35*c* gradually raises the speed by the action of the variable speed cam 41, and reverses the card C. The respective reversed cards C come in contact with the sides of the guide rail 53, and the further drop movements are regulated (position t of FIG. 2).

When all the cards Con the table are dropped to the position tin FIG. 2, the controller compares the mark and numeral inputted by the player through the operation of the buttons 18 before the distribution of the card C and the mark M of the card C recognized from the sensor unit 106, and carries out an operation as to the judgment of victory or defeat, the number of medals to be delivered according to a bet rate, and the like. The medal delivering device 17 corresponding to the player having won at the game is driven on the basis of the calculation result and a predetermined number of medals are delivered to the medal delivery port 16.

When the medal delivery is completed, the motor 55 is driven, and the collection plate 60 is moved from the position A to the position B of FIG. 3. At this time, as shown in FIG. 14, each of the cards C on the table is pressed to the engagement protrusion 62 of the collection plate 60 from the right, and the card, together with the collection plate 60, is sequentially collected to the accommodating device 110 side. As shown in FIG. 14, the six collected cards C are accommodated into the box 114 from the opening part 114*a* of the accommodation box 114 of the accommodating device 110. When the cards C are accommodated in the accommodation box 114, the motor 55 is inversion driven, and the collection plate 60 is returned to the position A of FIG. 3. A process of one game is ended here.

Figure 16:
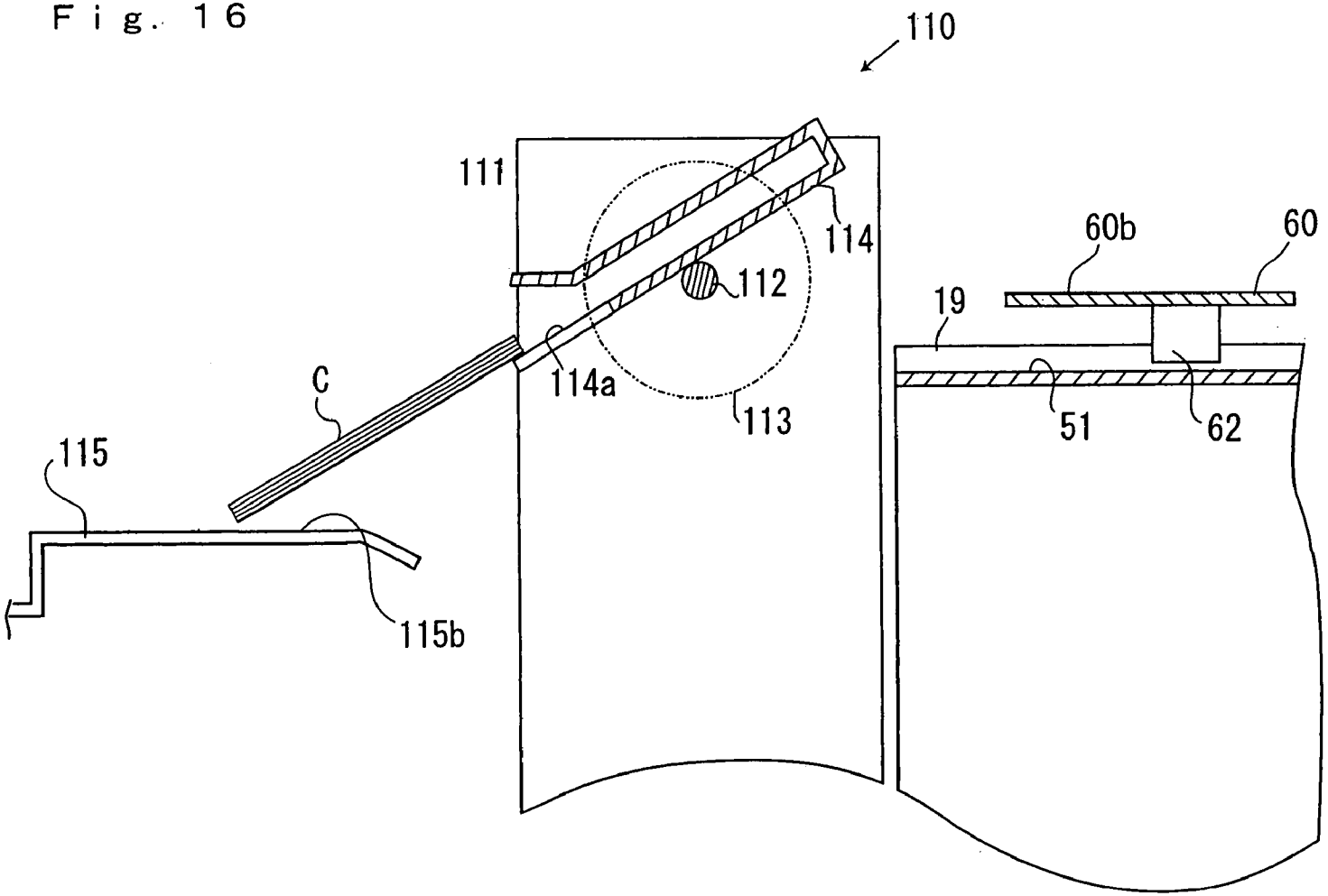
FIG. 16 is a side sectional view of the card accommodating device of the embodiment in a state where an accommodation box is rotated.

When the six cards C are accommodated in the accommodation box 114, the accommodation motor 113 is driven, and the accommodation box 114 is moved from the position of FIG. 15 to the position of FIG. 16. The cards C in the box 114 are moved onto the loading part 115*b* of the loading plate 115 according to the rotation of the accommodation box 114. Then, a next game is started, the card C is distributed from the distribution carrier 81 onto the table similarly to the above, and when the card C is collected by the collection plate 60, the card C in the accommodation box 114 is moved onto the loading part 115*b*. The motor 121 is driven so that the height of the loading part 115*b* relative to the accommodation box 114 becomes low according to the number of the cards C on the loading part 115*b*, and the position of the loading part 115*b* is gradually lowered. By this, even if the number of the cards C on the loading part 115*b* becomes large, the delivery of the card C to the loading part 115*b* from the accommodation box 114 is smoothly performed.

Figure 24:
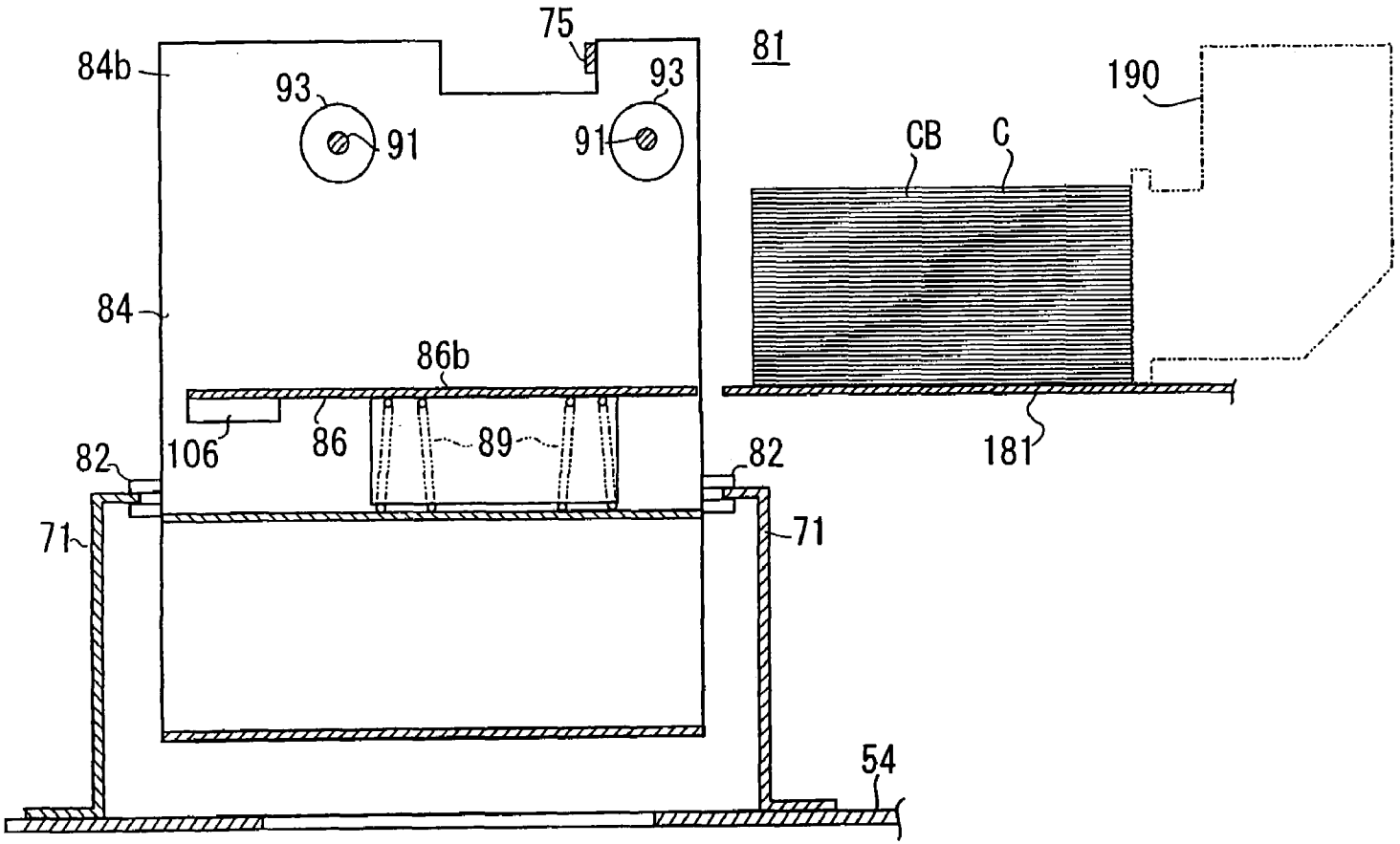
FIG. 24 is a side view before cards are delivered to the distribution carrier from a relay plate of the embodiment.

The game is repeatedly performed, and when the card C of the card group CA placed on the distribution carrier 81 is exhausted (or lessened), the distribution carrier 81 is moved to the position C opposite to the relay plate 181 of FIG. 3. As shown in FIG. 24, when the distribution carrier 81 is moved to the position opposite to the relay plate 181, the motor 185 is driven to advance the delivery plate 190, and the next card group CB on standby in the shuffle device 130 is transferred to the position adjacent to the distribution carrier 81. The motor of the distribution carrier 81 is driven, and the loading part 86*b* of the loading plate 86 is lowered to the minimum position, and the solenoid 103 is excited to protrude the rod 103*a*, and the facing relation between the press part 100*a* of the lever 100 and the loading surface 86*b* is released.

Figure 25:
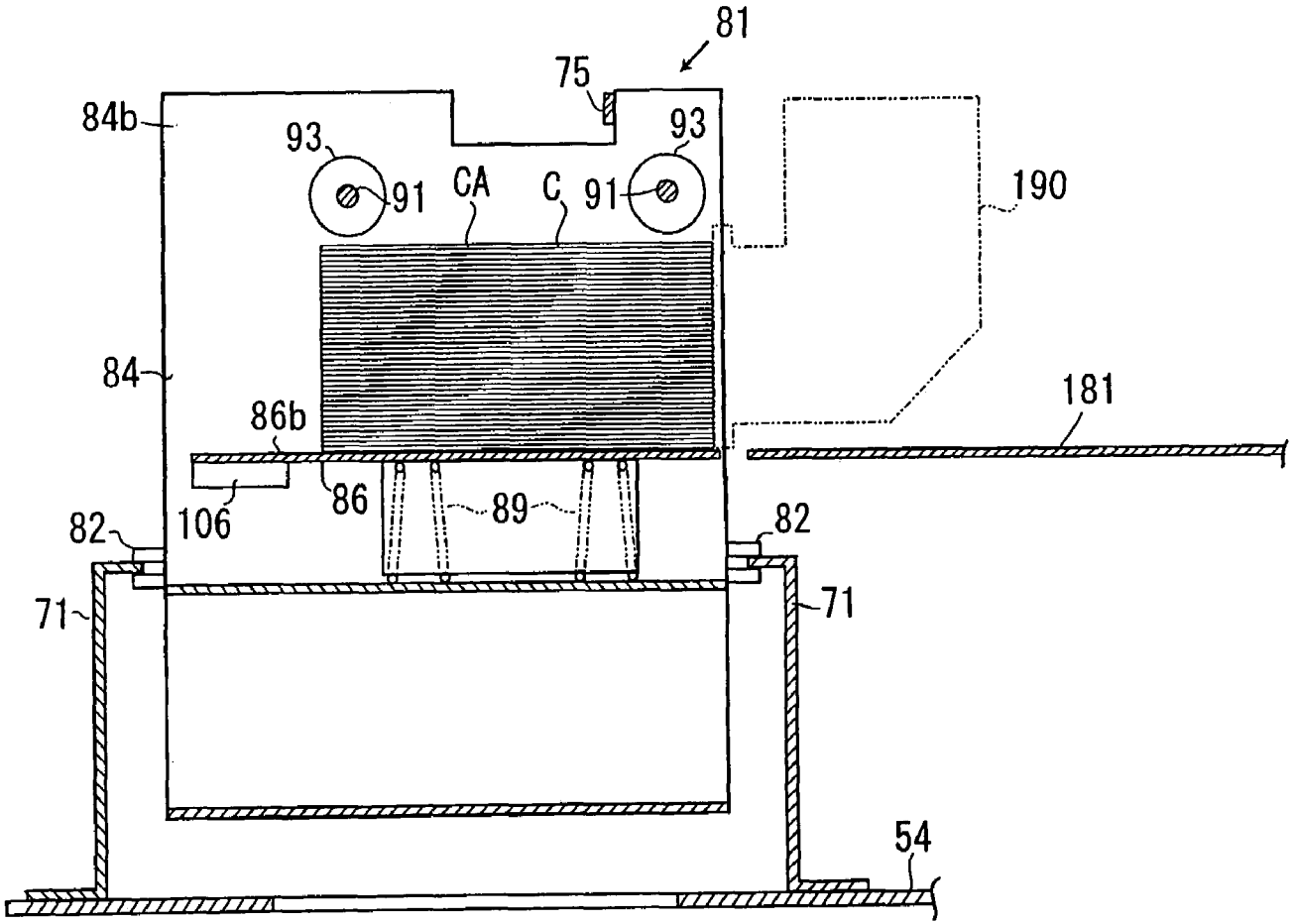
FIG. 25 is a side view of a state in which the cards are delivered to the distribution carrier from the relay plate of the embodiment.

In this state, as shown in FIG. 25, the delivery plate 190 is further advanced, and places the card group CB from the relay plate 181 onto the loading part 86*b* of the distribution carrier 81 (hereinafter, the card group becomes the card group CA when they are placed thereon). When the card group CA is newly placed on the distribution carrier 81, the motor 185 is inversion driven, and the delivery plate 190 goes back and is moved to the position E of FIG. 3. The motor of the distribution carrier 81 is driven at the same time as this to produce a state where the notch part 98*a* of the pinion gear 98 faces the rack 95, and engagement of both is released, the loading part 86*b* is vigorously raised by the elastic force of the coil spring 89, and as shown in FIG. 21, the card group CA is held between the loading part 86*b* and the supply roller 93 in a state where the elastic force of the coil spring 89 is given. When the game is started, as described before, the distribution carrier 81 is moved in the direction of the position D of FIG. 3, and the readout of the mark M of the card C and the distribution are performed.

Figure 26:
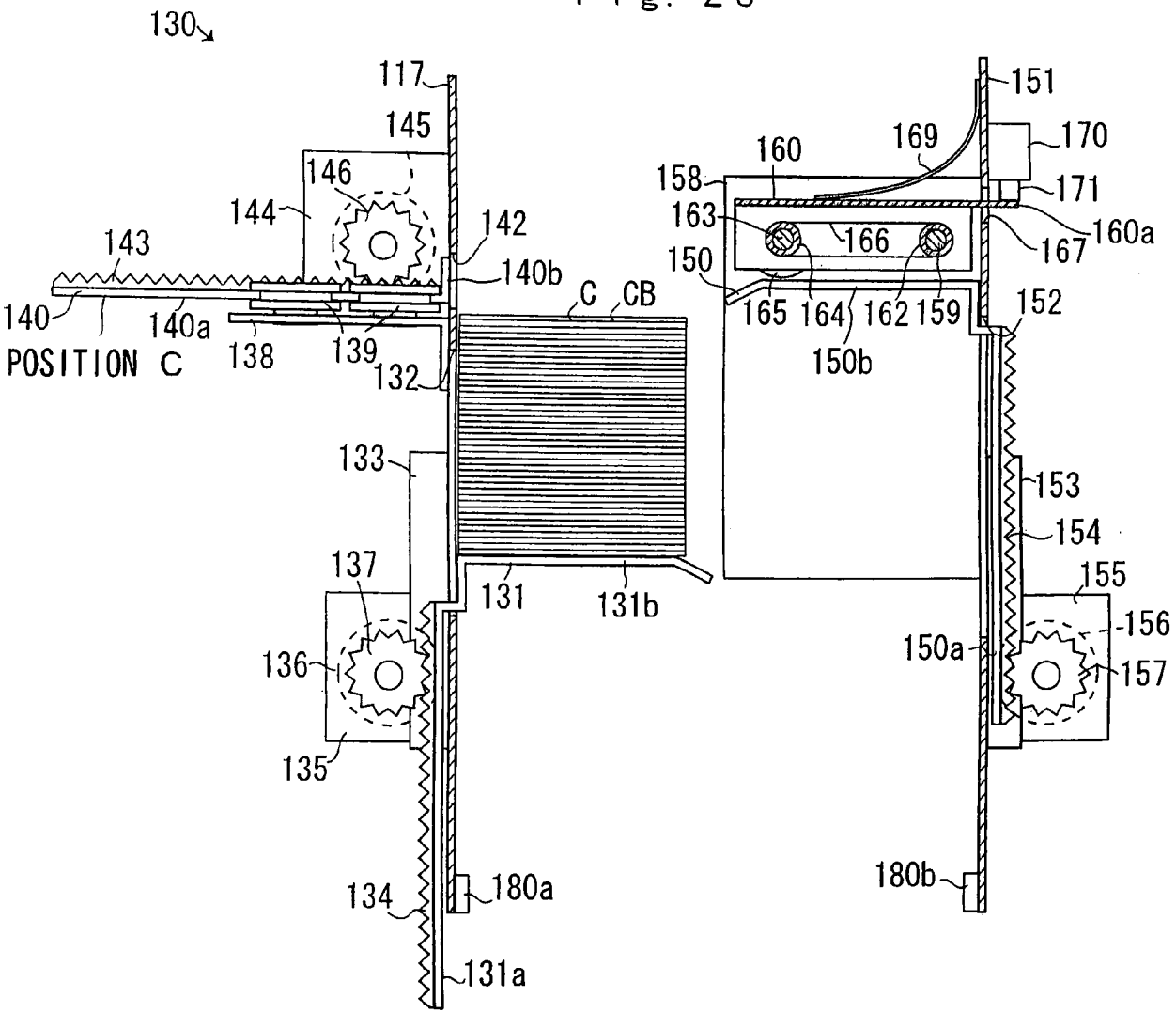
FIG. 26 is a side sectional view of a shuffle device of the embodiment in a state where the cards are placed on a feed side loading plate.
Figure 27:
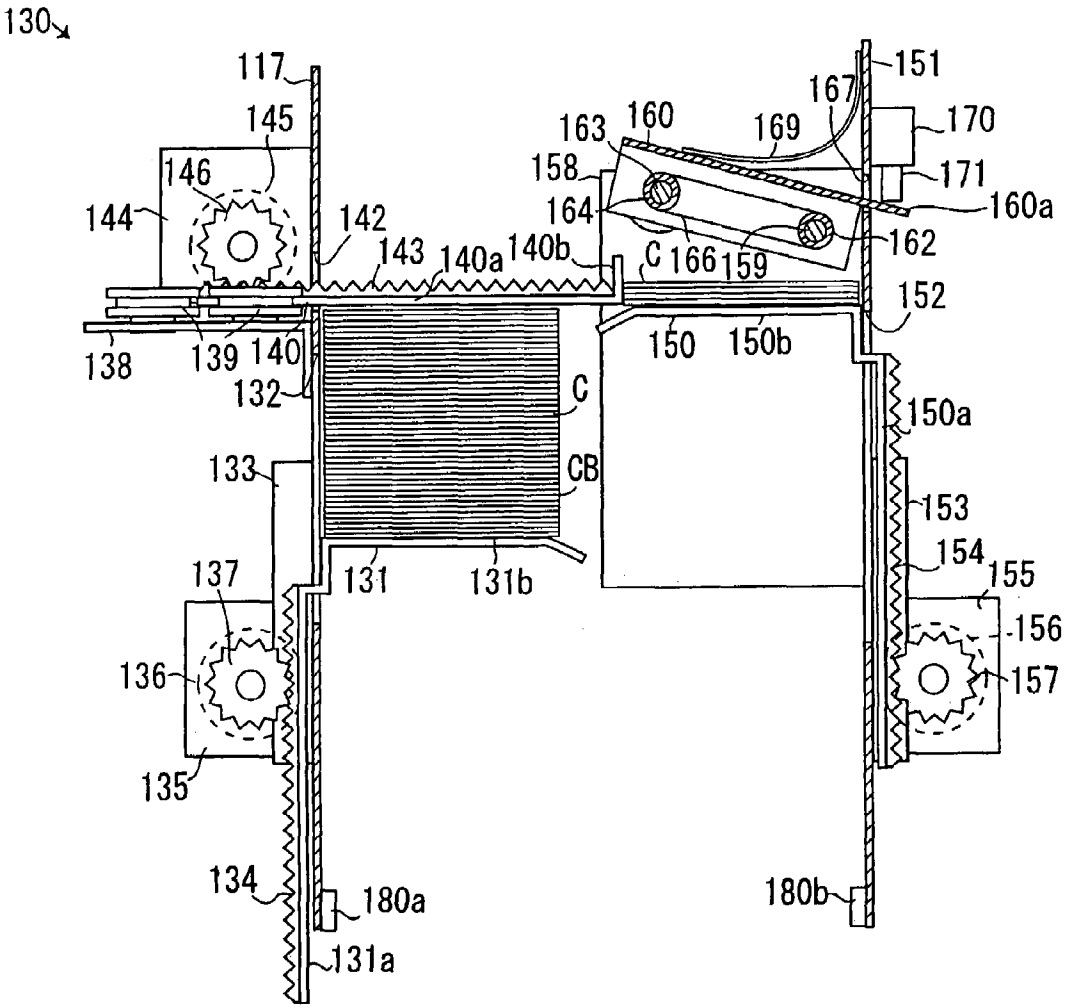
FIG. 27 is a side sectional view of the shuffle device of the embodiment in a state where the cards are delivered from the feed side loading plate to a reception side loading plate.

On the other hand, when a predetermined number (four sets) of card group CB are placed on the loading plate 115 of the accommodating device 110, the motor 121 is driven and the loading part 115*b* rises up to the highest position. The card group CB on the loading part 115*b* is transferred to the loading part 131*b* of the feed side loading plate 131 of the shuffle device 130 (see FIG. 26). When the card group CB is transferred onto the loading part 131*b* of the feed side loading plate 131, as shown in FIG. 27, the motor 136 is driven and the loading part 131*b* is raised by a predetermined amount. Next, the motor 145 is driven, and the push-out plate 140 protrudes to the reception side loading plate 150 side from the through hole 142. At this time, the bracket 160 is held in a tilt state according to the excitation of the solenoid 170. The height of the loading part 160*b* of the reception side loading plate 160 is held at a predetermined height previously set correspondingly to the height of the loading part 131*b* of the feed side loading plate 131. The height of both the loading parts 131*b* and 150*b* is drive controlled by the controller on the basis of signals from the sensors 180*a* and 180*b* for detecting the height of the loading parts 131*b* and 150*b*.

The push-out plate 140 protrudes to the reception side loading plate 150 side, so that plural cards C at the position opposite to the push-out part 140*b* of the push-out plate 140 are transferred to the loading part 150*b* side of the reception side loading plate 150 by the push-out part 140*b*. When the card C is transferred from the loading part 131*b* to the loading part 150*b*, the motor 145 is driven and the push-out plate 140 is returned to the position of FIG. 26. Subsequently, the remaining cards C on the loading part 131*b* are similarly delivered onto the loading part 150*b* of the reception side loading plate 150 several times. The position of the push-out plate 140 in the vertical direction is set at random each time push-out is performed. That is, a rising amount of the loading part 131*b* of the feed side loading plate 131 is changed, and a lowering position of the loading part 150*b* of the reception side loading plate 150 is also changed according to the rising position of the loading part 131*b* of the feed side loading plate 131.

Figure 28:
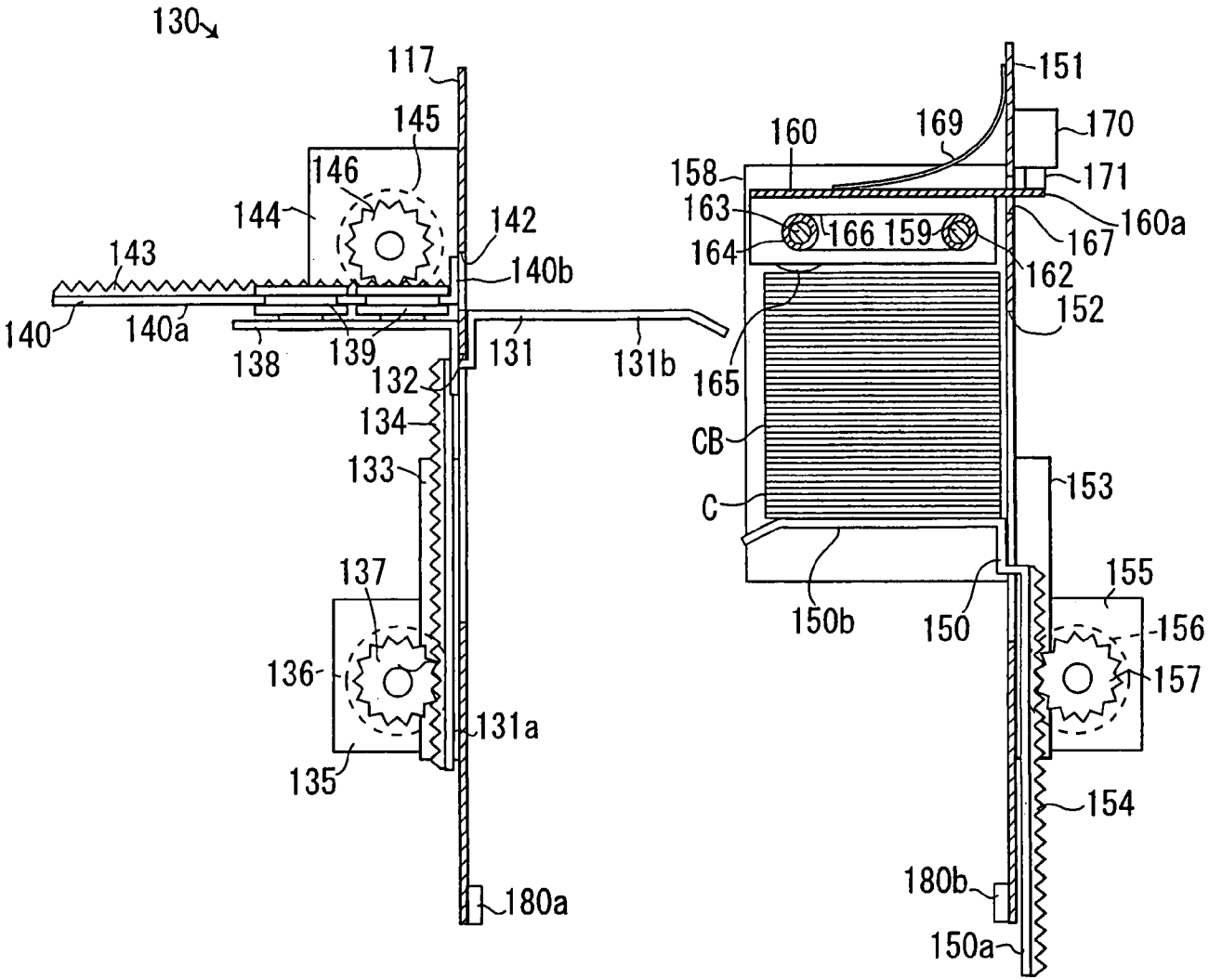
FIG. 28 is side sectional view of the shuffle device of the embodiment in a state where all the cards are delivered from the feed side loading plate to the reception side loading plate.
Figure 29:
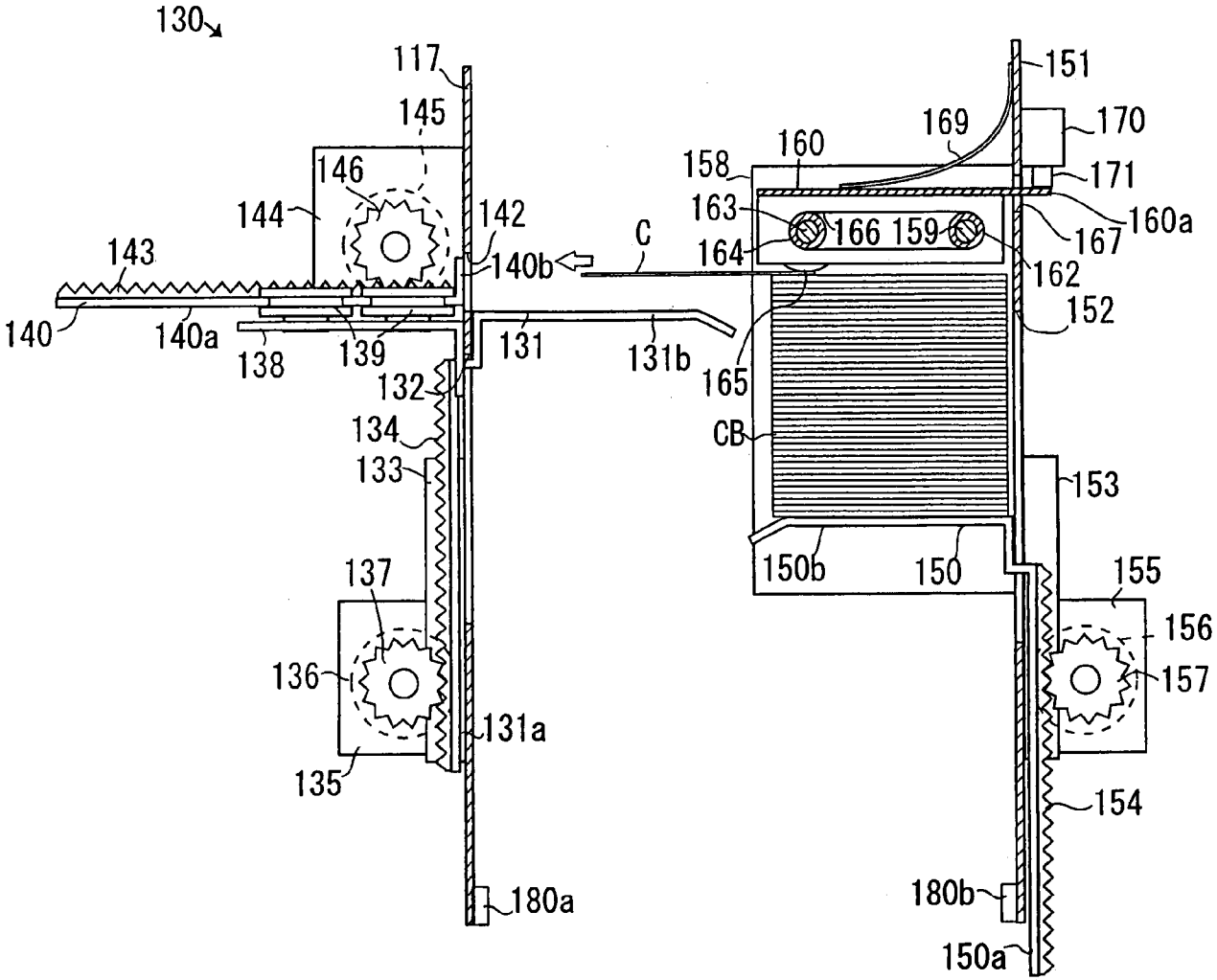
FIG. 29 is a side sectional view of the shuffle device in a state where the card is delivered from the reception side loading plate to the feed side loading plate one by one.

When all the cards C are delivered to the loading part 150*b* of the reception side loading plate 150, the operation of returning all the cards C to the feed side loading plate 131 is performed. As shown in FIG. 28, the excitation of the solenoid 170 is released, and the rod 171 of the solenoid 170 is contracted, so that the bracket 160 is returned into the horizontal state. At this time, the card group CB is held between the loading part 150*b* and the roller 165 in a state where the elastic force of the plate spring 169 is given. As shown in FIG. 29, the feed motor 161 is driven, and the card group CB on the loading part 150*b* in contact with the roller 165 is fed one by one onto the loading part 131*b* of the feed side loading plate 131. The loading part 150*b* is gradually raised according to the number of cards C fed to the feed side loading plate 131, so that it is possible to prevent a gap from occurring between the supply roller 156 and the card C. The loading part 131*b* of the feed side loading plate 131 is also gradually lowered according to the number of cards C.

When the supply of all the cards C from the reception side loading plate 150 side to the feed side loading plate 131 is ended, the delivery of the card group CB from the feed side loading plate 131 to the reception side loading plate 150 is performed. Similarly to the above, the card C is also fed one by one from the reception side loading plate 150. Plural (for example, five) delivery operations of the cards C are performed between the feed side loading plate 131 and the reception side loading plate 150. The number of cards delivered from the feed side loading plate 131 to the reception side loading plate 150 is set each time at random. The delivery is performed while the number of cards C is changed each time, so that the sequence of the cards C in the lamination state is greatly changed. That is, in this shuffle device 130, the shuffle (operation of mixing the cards C) of the card group CB is performed in this shuffle device 130. After a predetermined number of delivery operations are performed, the card group CB stands by on the lamination part 131*b* of the feed side card lamination plate 131.

The cards C distributed by the distribution carrier 81 are exhausted (lessened) and when the distribution carrier 81 is moved to the position C of FIG. 3, as described before, the card group CB on the lamination part 131*b* of the feed side lamination plate 131 is transferred by the delivery plate 190 onto the lamination part 86*b* of the card loading plate 86 of the distribution carrier 81.

The above operation is repeated, and the play by the card game machine 11 of this embodiment is performed.

According to this embodiment, since the card game machine 11 is constructed as described above, following effects can be obtained.

(1) As compared with the conventional game machine using the false cards such as images, in this embodiment, the real cards C are used, so that the reality of a game is improved, and the interest of the card game is greatly improved.

(2) The card C is distributed on the table, and the card C is pushed up and is reversed by the card reversing device 31 from the under surface. By this, it is not necessary to use a complicated mechanism such as to hold the card C and raise it from above, and in this embodiment, the card C can be reversed at low cost.

(3) The stopper 22 is provided at the predetermined part of the table, and in the state where the card C is in contact with the stopper 22, the upper part of the card C is pressed by the arms 35*a* to 35*c* of the reversing device 31, and the card C is rotated (reversed) around the contact part between the card C and the stopper 22 as the base point. As stated above, in this embodiment, the stopper 22 has both the function of stopping the card C at the predetermined position and the function of the base point when the card C is reversed. By this, the mechanism can be simplified, and the device can be manufactured at lower cost.

(4) The table is constructed of the stainless plate member to which the hairline is applied, so that the sliding of the card C is smoothly performed, and stress applied to the player during the game can be reduced.

(5) Since the guide plate 21 having almost the same width (slightly larger than the width of the card C) as the width of the card C is provided on the table, when the card C slides on the table, the rotation (direction of the card C) of the card C on the plane is prevented, and the shift of the sliding passage of the card C is prevented. By this, the state of the card C at the time of reversal and the state of the card C at the time of collection can be made always constant, and an operation miss of the card reversing device 31 and the card accommodating device 52 by the shift of the card C or the like can be suppressed.

(6) Two kinds of cams 40 and 41 constituting the reversing device 31 are used, and the structure is made such that the first and the second arms 35*a* and 35*b* are rotated at constant speed, and the rotation speed of the third arm 35*c* is gradually increased. That is, the reversal speed of the finally reversed card C is made lower than the reversal speed of the two other previously reversed cards C immediately after the reversal starts, and the rotation speed is gradually raised, so that the stage effect of the game is raised, and the effect that the player concentrates on the final card C can be expected. By this, the game can be played more pleasantly.

(7) The real cards C are used and the cards C before distribution are shuffled plural times by using the shuffle device 130. By this, the controller of the card game machine 11 can not also recognize the lamination sequence of the cards C. Accordingly, differently from the related art in which the cards are distributed on the basis of the previously determined program, it becomes very difficult for the player to expect the result of the game. As a result, the difficulty of the game is increased, and the game can be played more pleasantly.

(8) The distribution carrier 81 is provided with the sensor unit 106 including the CCD camera 107 and the LED 108, and the mark M of the card C before distribution is previously identified. The numeral, mark or the like inputted by the player through the operation of the button 18 is compared with the previously identified mark M of the card C, and the game result is judged before the card C is reversed on the table (judgment is made without notifying the player). By this, after the reversal of all the cards C is completed, the game result can be notified to the player quickly, and a smooth game proceeding becomes possible. As a result, stress is not given to the player and the game can be played more pleasantly.

(9) When the mark M of the card C is identified, the whole of the card C is not identified by the CCD camera 107, and only the mark M displayed on the corner of the card C is taken and is identified. By this, as compared with the case where the whole of the card C is taken, the CCD camera 107 can be miniaturized, and the card distributing device 70 can also be miniaturized.

(10) In this embodiment, in addition to the card group CA placed on the distribution carrier 81, the card group CB stands by in the shuffle device 130. Thus, even in the case where the game is performed plural times and the card group CA of the distribution carrier 81 is exhausted, the card group CB can be quickly transferred to the distribution carrier 81. That is, in the case where only one card group CA is prepared, unless all the cards C are collected and made the card group CA, the card group CA can not be transferred to the distribution carrier 81. In this case, a time in which the player is waiting until a next game is performed becomes long, and stress is given to the player. However, when two groups of the card groups CA and CB are prepared, the stress given to the player by the game standby time can be reduced. As a result, the game can be performed more pleasantly.

The invention may be embodied and carried out as follows.

In the above embodiment, the card reversing device 31 is constructed such that the card C on the table 19 as the tilt surface is pressed from the lower surface of the table 19 by the arms 35*a* to 35*c* and the card C is reversed. On the other hand, a structure may be made such that the air is sent from the lower surface of the table 19, the card C is blown by the wind force, and the card C is reversed.

All the cams 40 and 41 of the card reversing device 31 may be made the same to embody the invention. Besides, the cams may be axially fitted to the cam shaft 39 without shifting the phases of the press surfaces 40*a* and 41*a* of the cams 40 and 41.

A structure may be made such that in order to reverse the card C, apart of the table corresponding to the stop position of the card C is constructed to be reversed by the motor, and in the case where the card C is stopped at that area, the part of the table is rotated and the card C is reversed.

The guide plate 21 as the guide unit may not be provided to embody the invention.

In the above embodiment, the card is reversed such that the upper side of the card C falls on this side. On the other hand, a structure may be made such that at the stop position of the card C, a protrusion is provided at the right side of the card C, and the arms 35*a* to 35*c* of the card reversing device 31 press the left side of the card C with respect to the center, so that the card C is rotated in the right direction around the contact part between the card C and the protrusion as the base point, and the card C is reversed.

The card group CA may not be placed on the distribution carrier 81.

In addition to the normal cards on which numerals are depicted, for example, tarot cards may be used.

The number of cards C distributed on the table 19 per one game may be suitably changed.

The number of groups of the card groups CA and CB may be suitably changed.

The judgment of the game result by the controller may be performed after reversal of the card C.

In the above embodiment, although the sensor unit 106 for identifying the mark M of the card C as the card is provided on the distribution carrier 81, the sensor unit 106 may be provided on each of the spaces S1 to S6, and when the card C passes through the spaces S1 to S6, the mark M maybe identified.

In addition, the invention can be freely carried out in a mode modified within the scope not departing the gist of the invention. The present examples and embodiments are to be considered as illustrative and not restrictive and the invention is not to be limited to the details given herein, but may be modified within the scope and equivalence of the appended claims.

What is claimed is:

1. A card game machine for manipulating a plurality of playing cards, the card game machine comprising:

a holding unit for holding the plurality of cards in a stack;

a distribution unit for distributing the plurality of cards held by the holding unit one by one in a state wherein each of the cards is distributed face down;

a tilt surface, the tilt surface having a substantially flat surface set at an incline so that a lower end of the tilt surface projects farther forward than an upper end of the tilt surface, a plurality of channels being formed on the tilt surface for receiving the cards distributed by the distribution unit, each of the channels being defined by guides formed on the tilt surface on either side of each channel, the tilt surface being configured to receive the cards from the distribution unit, and allow the cards to slide down the channels under influence of gravity;

a stopper protruding from the tilt surface within each channel, each of the stoppers being configured to stop one of the cards at a specified position within the channel as the one card slides on the tilt surface, whereby each of the cards sliding on the tilt surface comes in contact with one of the stoppers and is stopped; and a card reversing unit for forcibly reversing the one card stopped by the stopper so that the one card is flipped over to expose a face of the one card, the card reversing unit being configured to apply a force to the one card at an upper area of the face of the one card causing the one card to rotate around an edge of the one card that is in contact with the stopper, wherein a back side of each of the cards that is stopped on the tilt surface is viewable, and the face of each of the cards is viewable after being reversed by the card reversing unit.

2. A card game machine according to claim 1, wherein the card reversing unit includes a pressing member, and the force is applied to the card by pressing the face of the card, which is placed face down, with the pressing member.

3. A card game machine according to claim 1, wherein the guides comprise a guide plate extending from the tilt surface along a length of the tilt surface on either side of each channel.

4. A card game machine according to claim 1, wherein the card reversing unit is configured to reverse each of the cards stopped by each of the stoppers, at different timings.

5. A card game machine according to claim 1, wherein the card reversing unit is configured to reverse the each of the cards stopped by each of the stoppers at different speeds.

6. A card game machine according to claim 1, wherein the holding unit and the distribution unit are configured to distribute the card to a specified one of the channels by moving horizontally above the tilt surface.

7. A card game machine according to claim 1, wherein the distribution unit is configured to sequentially distribute the cards to the tilt surface from a top of the stack, the cards in the stack being held face down.

8. A card game machine according to claim 1, further comprising a collection passage and a collection member, wherein the cards reversed by the card reversing unit are arranged on the collection passage, and the collection member moves in a direction from a tail end card to a leading end card so that the cards are gathered in a stacked state and are collected.

9. A card game machine according to claim 8, wherein the holding unit and the distribution unit are configured to move horizontally above the tilt surface and distribute the card to a specified one of the channels formed on the tilt surface.

10. A card game machine according to claim 9, wherein the guides comprise a guide plate extending from the tilt surface along a length of the tilt surface on either side of the channel.

11. A machine for displaying and reversing playing cards, the machine including:

an inclined surface having a plurality of elongated channels formed therein, each of the channels comprising a bottom surface and two side walls spaced sufficiently apart to permit one of the playing cards to slide along the channel between the two side walls;

a stop disposed in each of the channels, the stop comprising a protrusion from the bottom surface, the protrusion being configured and positioned to hold one of the playing cards at a predetermined position within a corresponding one of the channels;

a distribution mechanism configured to convey one of the playing cards to a top end of one of the channels and distribute the one of the playing cards to the one of the channels, the distribution causing the one playing card to slide down the channel to a corresponding one of the stops, the sliding being caused primarily to an effect of gravity on the playing card;

a push device associated with each of the channels, each of the push devices configured to push a top end of a corresponding one of the playing cards held at the predetermined position away from the bottom surface causing the playing card held by the stop to rotate about its lower edge, the push device thereby reversing the playing card and exposing a previously unexposed side of the playing card, the lower edge being in contact with the stop.

12. The machine of claim 11, farther comprising a window positioned over the inclined surface to enable viewing of the playing cards in the channels, the window including transparent plate preventing direct interaction with the playing cards other than by the machine.

13. The machine of claim 11, wherein the inclined surface is substantially flat and has a lower end positioned farther forward than an upper end, the two side walls of each of the channels comprising guide plates that extend along a length of the inclined surface.

14. The machine of claim 11, wherein the push device comprises a plurality of levers operated by a common cam shaft.

15. The machine of claim 11, wherein each of the reversed playing cards exits, under the influence of gravity, a lower end of a corresponding one of the channels and is displayed at a lower end of the inclined surface, the machine further comprising a collection assembly, the collection assembly comprising a carriage that travels across the inclined surface on a transversely disposed rail, the collection assembly collecting a plurality of reversed playing cards into a stack by pushing them to one side by a protrusion formed into the carriage.

16. The machine of claim 15, further comprising an accommodation mechanism comprising a box with an open end for receiving the stack of cards collected by the collection assembly and inverting the stack onto a loading plate, the loading plate being configured to convey at least the stack of cards to a shuffle device configured to reshuffle the cards.

17. The machine of claim 11, wherein the distribution mechanism comprises a distribution carrier that travels transversely across an upper end of the inclined surface along a guide rail, the distribution carrier containing a stack of the playing cards, the playing cards in the stack being held face down, the distribution mechanism further comprising a configured to drive the distribution carrier to position above a selected one of the channels, whereby the distribution mechanism then dispenses a top-most playing card from the stack of the playing cards.

18. The machine of claim 17, the distribution mechanism further comprising a reader device for reading markings on the top-most playing card being dispensed and translate the markings into an electronic signal interpretable by an electronic controller to identify the top-most card.

* * * * *